US006608594B1

(12) United States Patent
Kane et al.

(10) Patent No.: US 6,608,594 B1
(45) Date of Patent: Aug. 19, 2003

(54) ANTENNA APPARATUS AND COMMUNICATION SYSTEM

(75) Inventors: Joji Kane, Nara (JP); Hirotaka Ishihara, Ibaraki (JP); Noboru Nomura, Kyoto (JP); Shinji Naka, Moriyama (JP); Michio Sasaki, Yokohama (JP); Akinori Yanase, Yokohama (JP); Satoshi Yamada, Yokohama (JP); Hirokazu Kaidou, Yokohama (JP); Katsuya Tanioka, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/680,263

(22) Filed: Oct. 5, 2000

(30) Foreign Application Priority Data

Oct. 8, 1999 (JP) ..... 11-288550
Apr. 27, 2000 (JP) ..... 2000-127611

(51) Int. Cl.[7] ..... H01Q 1/38
(52) U.S. Cl. ..... 343/700 MS; 343/895; 343/834
(58) Field of Search ..... 343/700 MS, 895, 343/833, 834; H01Q 1/38

(56) References Cited

U.S. PATENT DOCUMENTS 2,520,988 A 9/1950 Everitt ..... 343/713
3,031,665 A 4/1962 Marie
3,624,658 A 11/1971 Voronoff ..... 343/895
3,982,243 A 9/1976 Gustavsson et al. ..... 342/50
4,791,423 A * 12/1988 Yokoyama et al. .. 343/700 MS
4,801,944 A 1/1989 Madnick et al. ..... 343/744
4,823,143 A 4/1989 Ohe et al. ..... 343/713
4,873,530 A 10/1989 Takeuchi et al. ..... 343/713

(List continued on next page.)

FOREIGN PATENT DOCUMENTS

EP 0 531 164 A1 3/1993
EP 0 831 545 A2 3/1998
EP 0 847 103 A2 6/1998
EP 0 884 796 A2 12/1998

(List continued on next page.)

*Primary Examiner*—Hoanganh Le
(74) *Attorney, Agent, or Firm*—Smith, Gambrell & Russell, LLP

(57) ABSTRACT

An antenna apparatus having at least one radiating element. A second radiating element is located opposite a first radiating element. Earth is on the side opposite to the first radiating element with respect to the second radiating element thus opposite to the second radiating element. The second radiating element intervenes between the first radiating element and earth. Either the first or the second radiating element employs a feed terminal.

27 Claims, 25 Drawing Sheets

U.S. PATENT DOCUMENTS

| | | | | | |
|---|---|---|---|---|---|
| 4,958,167 | A | | 9/1990 | Schroeder | 343/713 |
| 5,043,738 | A | * | 8/1991 | Shapiro et al. | 343/700 MS |
| 5,124,733 | A | * | 6/1992 | Haneishi | 343/700 MS |
| 5,153,600 | A | * | 10/1992 | Metzler et al. | 343/700 MS |
| 5,177,493 | A | | 1/1993 | Kawamura | 343/713 |
| 5,420,596 | A | | 5/1995 | Burrell et al. | 343/700 |
| 5,442,368 | A | | 8/1995 | Harada et al. | 343/713 |
| 5,457,467 | A | | 10/1995 | Schenkyr et al. | 343/713 |
| 5,568,155 | A | * | 10/1996 | Tsunekawa et al. | 343/700 MS |
| 5,572,226 | A | | 11/1996 | Tuttle | 343/726 |
| 5,576,718 | A | | 11/1996 | Buralli et al. | 343/700 |
| 5,585,807 | A | | 12/1996 | Takei | 343/700 |
| 5,627,550 | A | | 5/1997 | Sanad | 343/700 |
| 5,680,144 | A | * | 10/1997 | Sanad | 343/700 MS |
| 5,874,919 | A | | 2/1999 | Rawnick et al. | 343/700 |
| 5,874,926 | A | | 2/1999 | Tsuru et al. | 343/713 |
| 5,929,825 | A | | 7/1999 | Niu et al. | 343/895 |
| 5,963,181 | A | | 10/1999 | Abe | 343/895 |
| 5,966,097 | A | | 10/1999 | Fukasawa et al. | 343/700 |
| 6,057,803 | A | | 5/2000 | Kane et al. | 343/713 |
| 6,061,024 | A | | 5/2000 | McGirr et al. | 343/700 |
| 6,118,406 | A | | 9/2000 | Josypenko | 343/700 |
| 6,166,694 | A | * | 12/2000 | Ying | 343/702 |
| 6,295,030 | B1 | | 9/2001 | Kozakai et al. | 343/700 |
| 6,339,402 | B1 | | 1/2002 | McKivergan | 343/700 |
| 6,343,208 | B1 | | 1/2002 | Ying | 343/702 |
| 6,353,443 | B1 | | 3/2002 | Ying | 343/700 |

FOREIGN PATENT DOCUMENTS

| | | |
|---|---|---|
| JP | 56-713 | 1/1981 |
| JP | 56-31235 | 3/1981 |
| JP | 64-38845 | 3/1989 |
| JP | 1-158808 | 6/1989 |
| JP | 3-53014 | 5/1991 |
| JP | 4-207303 | 6/1992 |
| JP | 4-282903 | 10/1992 |
| JP | 5-41211 | 6/1993 |
| JP | 5-175727 | 6/1993 |
| JP | 5-70013 | 9/1993 |
| JP | 5-299935 | 11/1993 |
| JP | 6-51008 | 2/1994 |
| JP | 6-69771 | 3/1994 |
| JP | 6-261019 | 9/1994 |
| JP | 7-336130 | 12/1995 |
| JP | 8-78943 | 3/1996 |
| JP | 8-321820 | 12/1996 |
| JP | 8-340315 | 12/1996 |
| JP | 9-181699 | 7/1997 |
| JP | 9-260925 | 10/1997 |
| JP | 10-107777 | 4/1998 |

* cited by examiner

ANTENNA APPARATUS AND COMMUNICATION SYSTEM

BACKGROUND OF THE INVENTION

1. Field of the Invention

The present invention relates to an antenna apparatus and a communication system.

2. Related Art of the Invention

First, the configuration of an antenna apparatus according to the prior art will be described with reference to FIG. 20 and FIG. 21. FIG. 20 is a conceptual diagram providing comparative descriptions of a double-spiral antenna according to the prior art, a circular patch type antenna according to the prior art, and the composite antenna of the present invention. FIG. 21 is a conceptual diagram providing comparative descriptions of the performance characteristics of a double-spiral antenna according to the prior art and the composite antenna of the present invention.

First, the configuration of a double-spiral antenna according to the prior art will be described with reference to FIG. 20.

A spiral radiating element 107 has a feed terminal 105 that is given common termination via a sharing unit (not shown) and is connected to a reception input terminal (not shown) and a transmission output terminal (not shown) of a communication apparatus (not shown). The limit of the length L3 of the spiral radiating element 107 is about ¼ of an electric wave wavelength. Therefore, when 1454 MHz is a resonance frequency, for example, the spiral radiating element 107 is designed so that a length L3 of the spiral radiating element 107 is approximately 51.6 mm.

A circular patch type radiating element 108 is located opposite the spiral radiating element 107. A limit of the circumferential length L4 of the circular patch type radiating element 108 is about ½ of the electric wave wavelength. Therefore, when the resonance frequency is 1513 MHz, for example, the circular patch type radiating element 108 is designed so that the circumferential length L4 of the circular patch type radiating element 108 is approximately 99.1 mm.

An inductance 109 is a metal tab for connecting the spiral radiating element 107 and circular patch type radiating element 108, and stabilizing a potential of the spiral radiating element 107.

A spiral parasitic element 110 is a part that does not have a feed terminal and is fitted parallel to the spiral radiating element 107. As shown in FIG. 21, the gain of an antenna that has a spiral parasitic element 110 (an antenna that has a double-spiral element), is better than the gain of an antenna that does not have a spiral parasitic element 110 (an antenna that has a single-spiral element).

The operation of a double-spiral antenna according to the prior art that has this kind of configuration will now be described with reference to FIG. 20. As the reception operation of a double-spiral antenna according to the prior art is understood as virtually the opposite of the transmission operation described below, only the transmission operation will be described below.

The transmission output terminal (not shown) of a communication apparatus (not shown) performs signal output to the spiral radiating element 107 via the feed terminal 105.

The electric field 155 generated between the spiral radiating element 107 and the circular patch type radiating element 108, due to the above described signal output from the communication apparatus (not shown), is sent as a transmission electric wave.

Next, the configuration of a circular patch type antenna according to the prior art will be described with reference to FIG. 20.

The circular patch type radiating element 108 has a feed terminal 105 that is given common termination via a sharing unit (not shown) and is connected to the reception input terminal (not shown) and transmission output terminal (not shown) of a communication apparatus (not shown).

An earth plate 104 is located opposite the circular patch type radiating element 108.

The operation of a circular patch type antenna according to the prior art that has this kind of configuration will now be described with reference to FIG. 20. As the reception operation of a circular patch type antenna is understood as virtually the opposite of the transmission operation described below, only the transmission operation will be described below.

The transmission output terminal (not shown) of the communication apparatus (not shown) performs signal output to the circular patch type radiating element 108 via the feed terminal 105.

An electric field 156 generated between the circular patch type radiating element 108 and the earth plate 104, due to the above described signal output from the communication apparatus (not shown), is sent as a transmission electric wave.

Incidentally, as shown in FIG. 20, a double-spiral antenna according to the prior art has good gain in the transmission band (1453 MHz to 1465 MHz), but does not have good gain in the reception band (1501 MHz to 1513 MHz). Also, as shown in FIG. 20, a circular patch type antenna according to the prior art has good gain in the reception band (1501 MHz to 1513 MHz), but does not have good gain in the transmission band (1453 MHz to 1465 MHz).

Summary of the Invention

The present invention has been achieved by taking into account the actual problems described above, and it is an objective of the present invention to provide an antenna apparatus and communication system that enable high gain and an increase in specific-bandwidth to be achieved.

An antenna apparatus of the present invention comprises:

a first radiating element;

a second radiating element located opposite the first radiating element; and an earth on the opposite side to the first radiating element with respect to the second radiating element, and opposite the second radiating,element, wherein the first radiating element or the second radiating element is equipped with a feed terminal, and electric fields are generated at least between the first radiating element and the second radiating element, and between the second radiating element and the earth, and electric wave transmission and reception is performed.

An antenna apparatus of the present invention comprises:

a first radiating element;

a second radiating element located opposite the first radiating element; and a third radiating element on the opposite side to the first radiating element with respect to the second radiating element, and opposite the second radiating element, wherein the first radiating element and the third radiating element are equipped with a feed terminal, and electric fields are generated at least between the first radiating element and the second radiating element, and between the second radiating element and the third radiating element, and electric wave transmission and reception is performed.

A communication system of the present invention comprises:

an antenna apparatus including: a first radiating element; a second radiating element located opposite the first radiating element; and an earth on the opposite side to the first radiating element with respect to the second radiating element, and opposite the second radiating element, wherein the first radiating element or the second radiating element is equipped with a feed terminal, electric fields are generated at least between the first radiating element and the second radiating element, and between the second radiating element and the earth, and electric wave transmission and reception is performed; and a distributor for connecting the feed terminal to a communication apparatus for linear polarization and/or a communication apparatus for circular polarization.

A communication system of the present invention comprises:

an antenna apparatus including: a first radiating element; a second radiating element located opposite the first radiating element; and a third radiating element on the opposite side to the first radiating element with respect to the second radiating element, and opposite the second radiating element, wherein the first radiating element and the third radiating element are equipped with a feed terminal, electric fields are generated at least between the first radiating element and the second radiating element, and between the second radiating element and the third radiating element, and electric wave transmission and reception is performed; and a distributor for connecting the feed terminal to a communication apparatus for linear polarization and/or a communication apparatus for circular polarization.

As shown in FIG. 20 and FIG. 21, the antenna apparatus of the present invention, for example, uses an electric field which is the composite sum of electric field 155 and electric field 156 as transmission and reception electric waves, and has good gain in both the reception band and the transmission band.

DESCRIPTION OF SYMBOLS

Figure 1A:
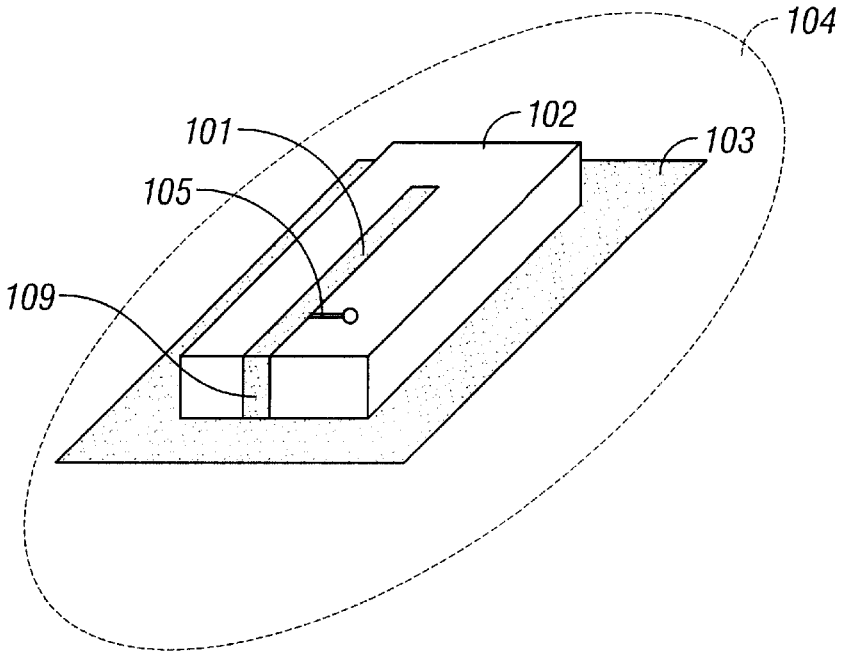
FIG. 1 includes an oblique drawing of an antenna apparatus with dielectric inserted described in embodiment 1 of the present invention (FIG. 1A), and an oblique drawing of the antenna apparatus with no dielectric inserted (FIG. 1B)

101 Linear radiating element
102 Dielectric
103 Patch type radiating element
104 Earth plate
105 Feed terminal
106 Linear parasitic element
107 Spiral radiating element
108 Circular patch type radiating element
109 Inductance
110 Spiral parasitic element
201 Earth plate (with finite area)
301 Printed circuit board
501 Linear radiating element supporting stand
502 Patch type radiating element supporting pillar
701 Case
702 Area above (of case 701)
703 Edge (of case 701)
801 Cable earth
802 Earth
901 Cover
1001 Linear radiating element
1101 Metal pedestal
1201 Feeder line
1301 Capacitor
2001 First spiral radiating element
2002 Second spiral radiating element
2003 Circular patch type element
2004, 2004' Spiral parasitic element
2005 Feed terminal
2006, 2006' Inductance
2007 Dielectric
2011 Electric field due to first spiral radiating element
2012 Electric field due to second spiral radiating element
2013 Directivity due to first spiral radiating element
2014 Directivity due to second spiral radiating element
2021, 2021' Capacitor
2022, 2022' Feed line
2031 Mixer
2041 Coaxial cable
2042 Distributor
2043 Communication apparatus for linear polarization
2044 Communication apparatus for circular polarization

DETAILED DESCRIPTION OF THE PREFERRED EMBODIMENTS

With reference to the attached drawings, the embodiments of the present invention will be described in detail below.

Embodiment 1

Figure 1B:
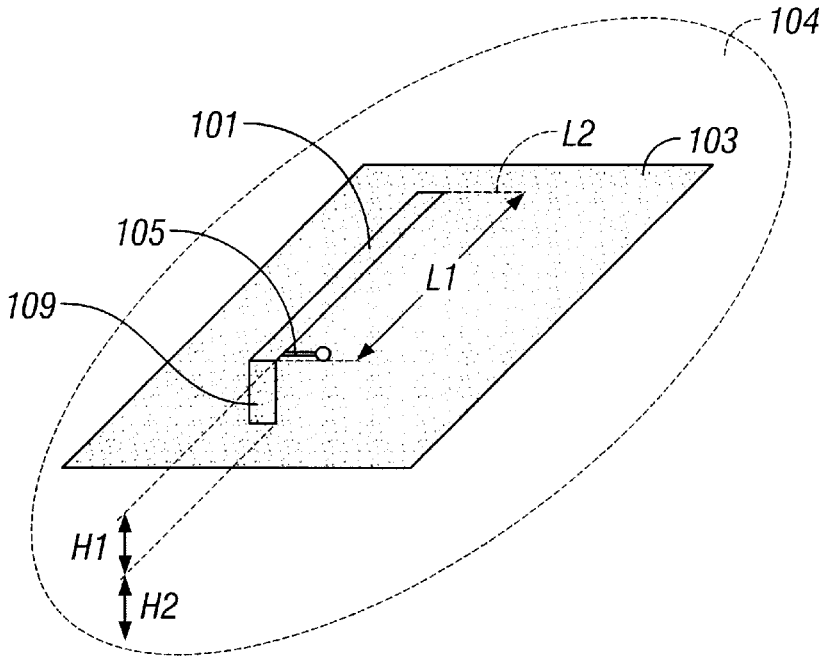

First, the configuration of the antenna apparatus in embodiment 1 will be described with reference to FIGS. 1A and 1B. As will be mentioned later, in the antenna apparatus shown in FIG. 1A, a dielectric 102 is inserted between a linear radiating element 101 that is rectilinear in shape and a patch type radiating element 103, whereas a dielectric 102 is not inserted in the antenna apparatus shown in FIG. 1B; the antenna apparatus of the present embodiment below has a configuration in which a dielectric is inserted.

The linear radiating element 101 is made of metal, and has a feed terminal 105 that is given common termination via a sharing unit (not shown) and is connected to the reception input terminal (not shown) and transmission output terminal (not shown) of a communication apparatus (not shown). The linear radiating element 101 in embodiment 1 corresponds to the first radiating element of the present invention.

The patch type radiating element 103 is made of metal, and is located opposite the linear radiating element 101. The patch type radiating element 103 in embodiment 1 corresponds to the second radiating element of the present invention.

The earth plate 104 is made of metal, and is located on the opposite side to the linear radiating element 101 with respect to the patch type radiating element 103, and opposite the patch type radiating element 103. The earth plate 104 is earthed and has an essentially infinite area. The earth plate 104 in embodiment 1 corresponds to the earth of the present invention.

The inductance 109 is a metal tab for connecting the linear radiating element 101 and the patch type radiating element 103, and stabilizing the potential of the linear radiating element 101.

The dielectric 102 is a part formed from ceramic material that is inserted between the linear radiating element 101 and patch type radiating element 103, and has the function of a spacer. The dielectric 102 also supports the linear radiating element 101.

In an antenna apparatus in which a dielectric 102 is not inserted (see FIG. 1B), the design parameter standards when the transmission band frequency is 1453 MHz to 1465 MHz and the reception band frequency is 1501 MHz to 1513 MHz are as follows.

The limit of the height HI of the linear radiating element 101 with respect to the patch type radiating element 103 is about 1/20 of the electric wave wavelength. The limit of the height H2 of the patch type radiating element 103 with respect to the earth plate 104 is about 1/60 of the electric wave wavelength. The limit of the length L1 of the linear radiating element 101 is about 1/4 of the electric wave wavelength. The limit of the circumferential length L2 of the patch type radiating element 103 is about ½ of the electric wave wavelength.

Figure 2:
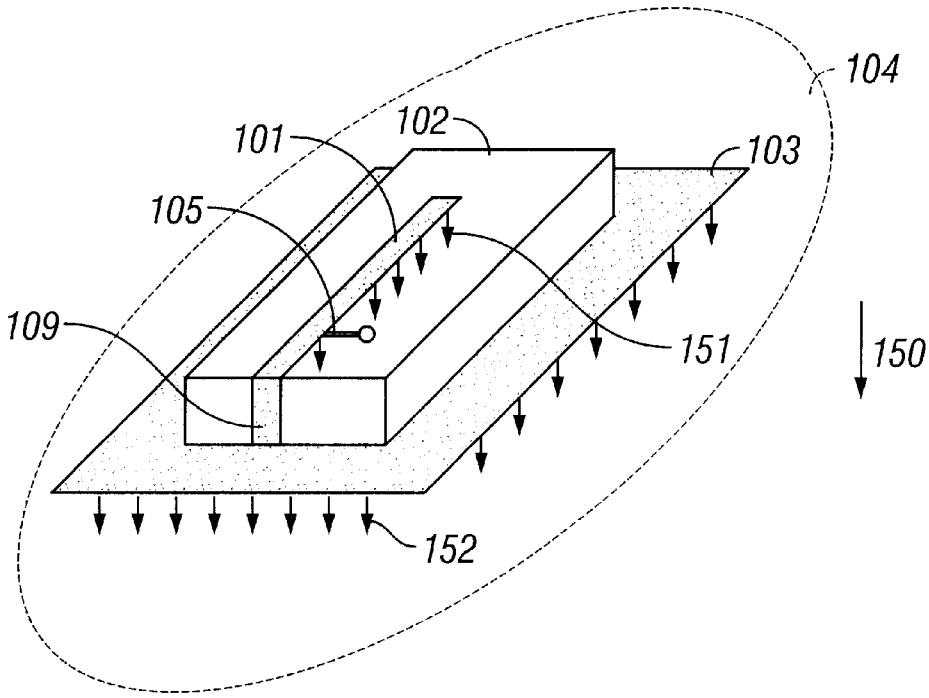
FIG. 2 is a type drawing for explaining a transmission operation of the antenna apparatus described in embodiment 1.

The operation of the antenna apparatus in embodiment 1 that has this kind of configuration will now be described with reference to FIG. 2. FIG. 2 is a schematic drawing for explaining the transmission operation of the antenna apparatus in embodiment 1. As the reception operation of the antenna apparatus in embodiment 1 is understood as virtually the opposite of the transmission operation described below, only the transmission operation will be described below.

The transmission output terminal (not shown) of the communication apparatus (not shown) performs signal output to the linear radiating element 101 via the feed terminal 105.

Due to the above described signal output from the communication apparatus (not shown), an electric field 151 is generated between the linear radiating element 101 and the patch type radiating element 103. Also, due to the above described signal output from the communication apparatus (not shown), an electric field 152 is generated between the patch type radiating element 103 and the earth plate 104.

The electric field 150, which is the composite sum of electric field 151 and electric field 152, is sent as the transmission electric wave.

Figure 6:
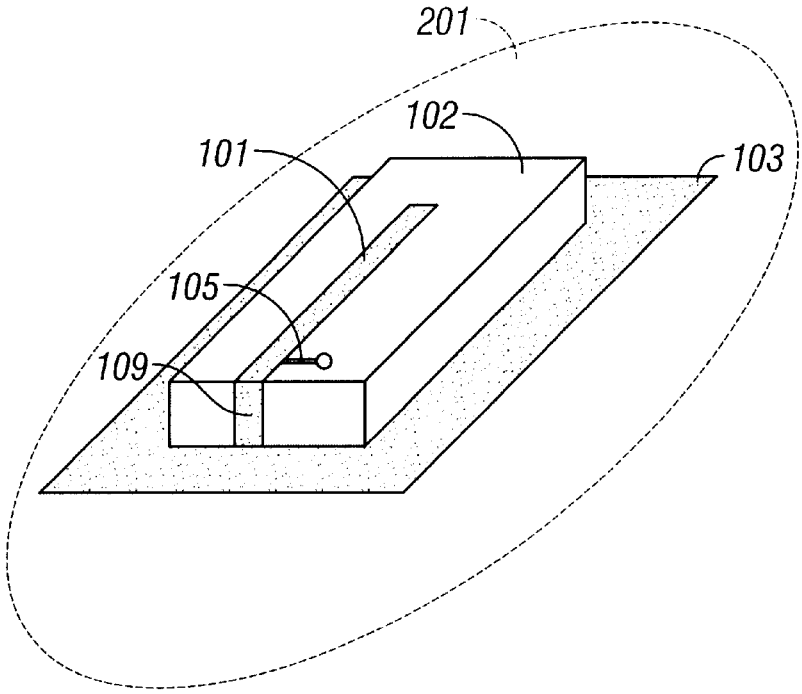
FIG. 6 is an oblique drawing of the antenna apparatus described in embodiment 1 of the present invention.

The earth plate 104 in embodiment 1 need not have an essentially infinite area, and as shown in FIG. 6, need only have an area roughly 3 times or more the area of the patch type radiating element 103. FIG. 6 is an oblique drawing of an antenna apparatus that has an earth plate 201 with a finite area.

Figure 10:
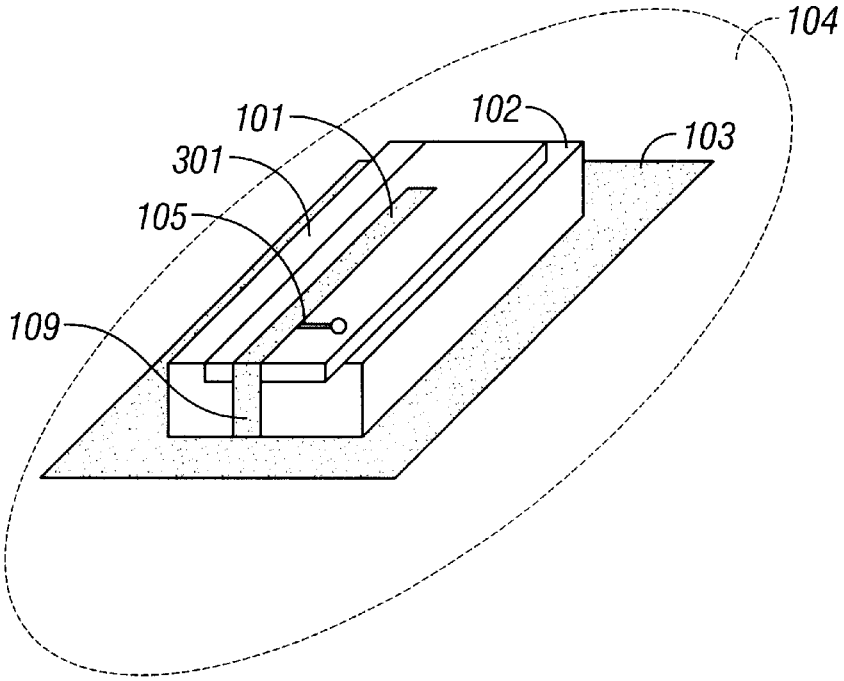
FIG. 10 is an oblique drawing of the antenna apparatus described in embodiment 1 of the present invention.

Also, a printed circuit board 301 such as that shown in FIG. 10 can also be installed between the linear radiating element 101 and the patch type radiating element 103 in embodiment 1, and the linear radiating element 101 can also be formed on the printed circuit board 301. FIG. 10 is an oblique drawing of an antenna apparatus with a printed circuit board 301 installed.

Embodiment 2

Figure 3A:
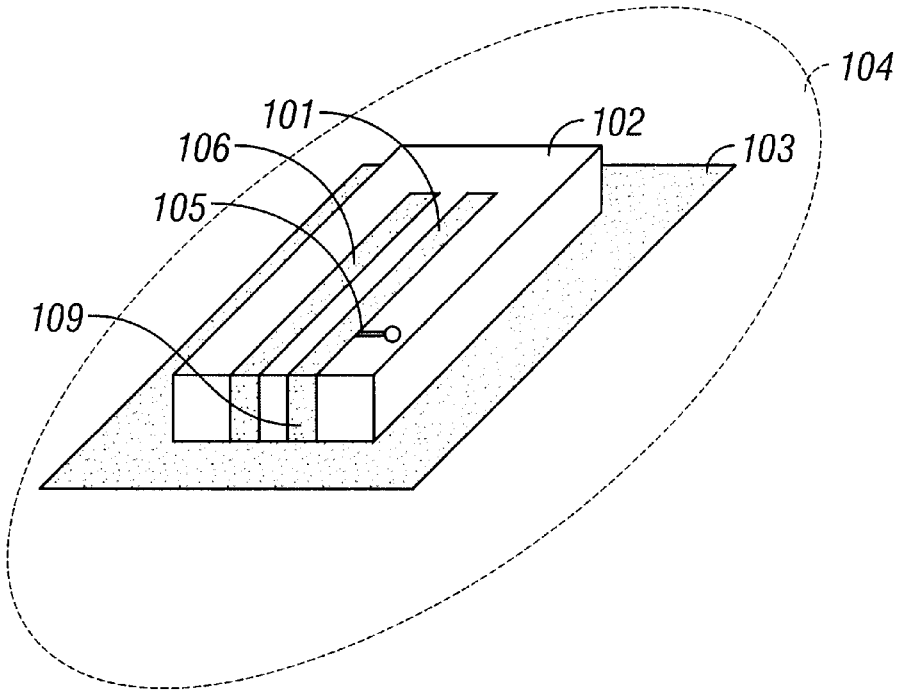
FIG. 3 includes an oblique drawing of the antenna apparatus with dielectric inserted described in embodiment 2 of the present invention (FIG. 3A), and an oblique drawing of the antenna apparatus with no dielectric inserted (FIG. 3B)
Figure 3B:
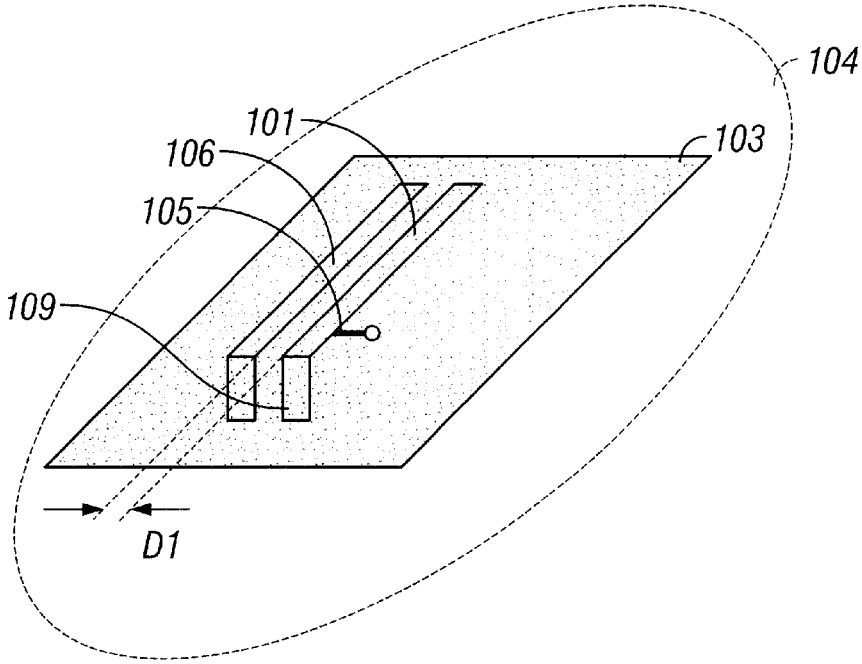

First, the configuration of the antenna apparatus in embodiment 2 will be described with reference to FIGS. 3A and 3B. In the antenna apparatus shown in FIG. 3A, a dielectric 102 is inserted between a linear radiating element 101 and a patch type radiating element 103, whereas such a dielectric is not inserted in the antenna apparatus shown in FIG. 3B; the antenna apparatus of the present embodiment below has a configuration in which a dielectric is inserted.

The antenna apparatus in embodiment 2 differs from the antenna apparatus in embodiment 1 in being equipped with a linear parasitic element 106 that is rectilinear in shape, described next.

The linear parasitic element 106 is a part made of metal that does not have a feed terminal and is fitted parallel to the linear radiating element 101. As already explained, due to the presence of the linear parasitic element 106, the gain of the antenna apparatus in embodiment 2 is better than the gain of the antenna apparatus in embodiment 1.

In an antenna apparatus in which a dielectric 102 is not inserted (see FIG. 3B), when the transmission band frequency is 1453 MHz to 1465 MHz and the reception band frequency is 1501 MHz to 1513 MHz, the limit of the gap D1 between the linear radiating element 101 and the linear parasitic element 106 is about 1/600 of the electric wave wavelength.

The operation of the antenna apparatus in embodiment 2 that has this kind of configuration is the same as the operation of the antenna apparatus in embodiment 1.

Figure 7:
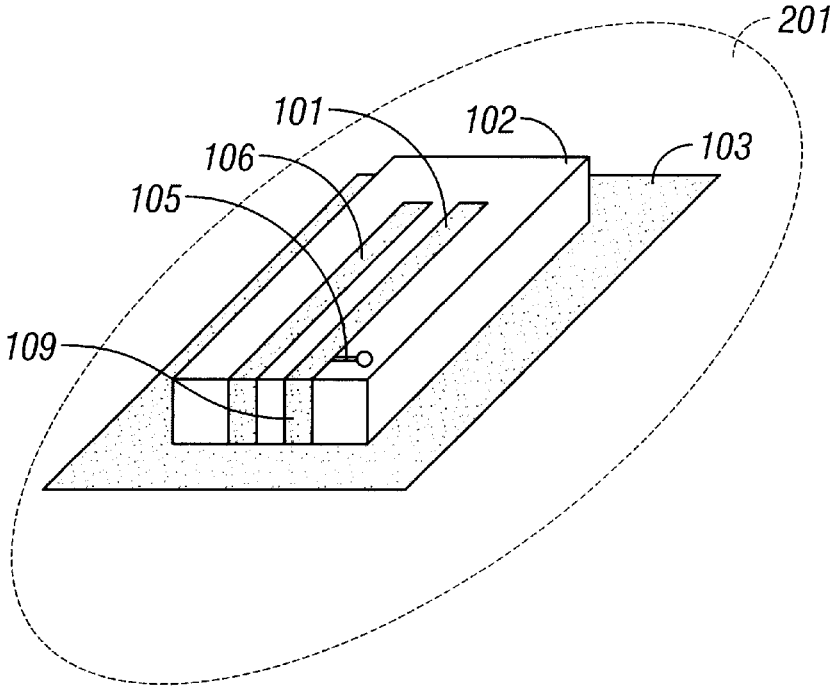
FIG. 7 is an oblique drawing of the antenna apparatus described in embodiment 2 of the present invention.

The earth plate 104 in embodiment 2 need not have an essentially infinite area, and as shown in FIG. 7, need only have an area roughly 3 times or more the area of the patch type radiating element 103. FIG. 7 is an oblique drawing of an antenna apparatus that has an earth plate 201 with a finite area.

Figure 11:
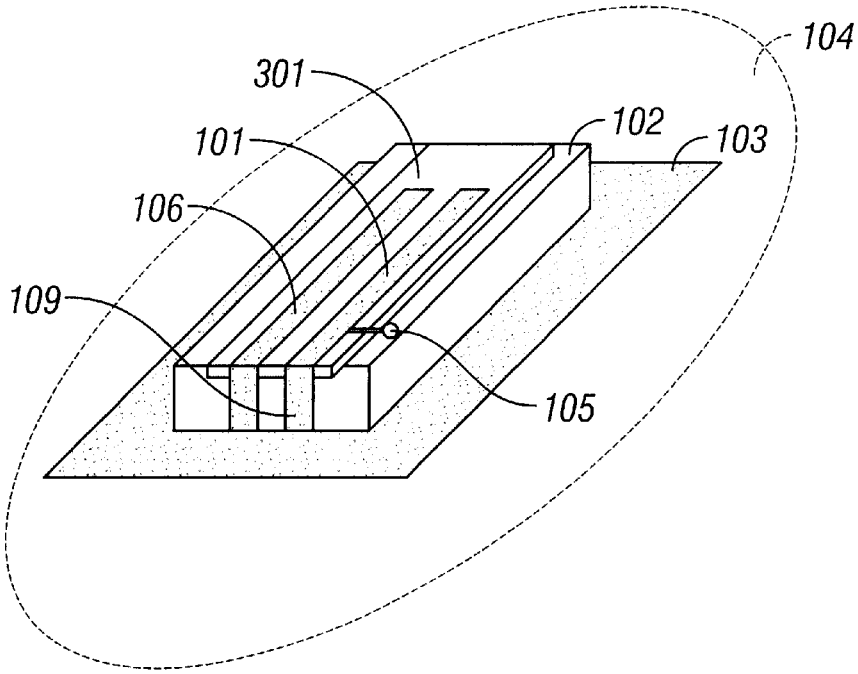
FIG. 11 is an oblique drawing of the antenna apparatus described in embodiment 2 of the present invention.

Also, a printed circuit board 301 such as that shown in FIG. 11 can also be installed between the linear radiating element 101 and the patch type radiating element 103 in embodiment 2, and the linear radiating element 101 can also be formed on the printed circuit board 301. FIG. 11 is an oblique drawing of an antenna apparatus with a printed circuit board 301 installed.

Embodiment 3

Figure 4A:
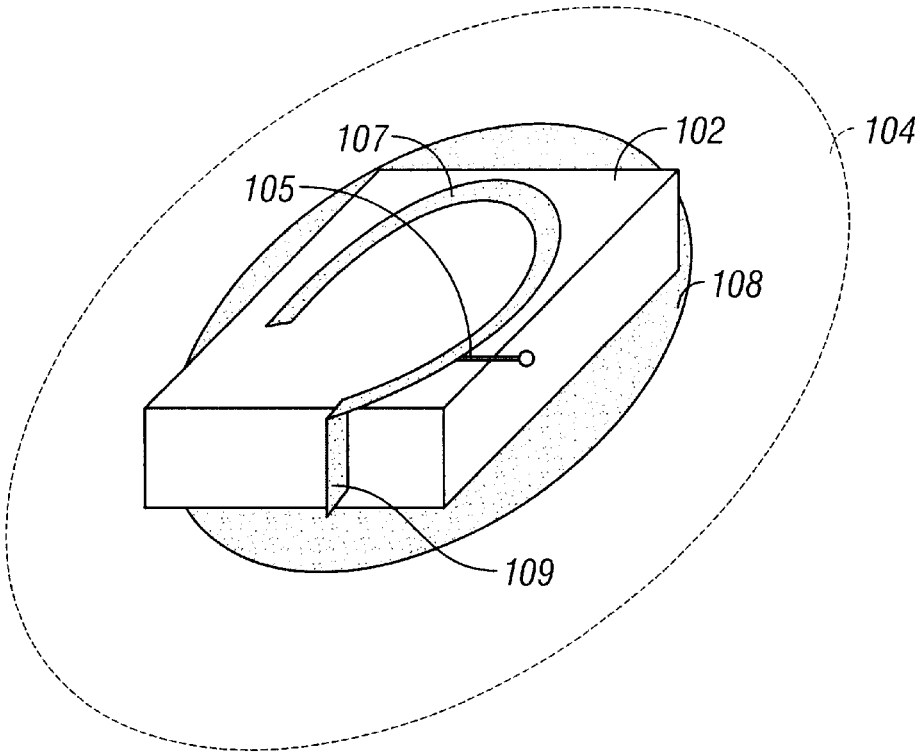
FIG. 4 includes an oblique drawing of the antenna apparatus with dielectric inserted described in embodiment 3 of the present invention (FIG. 4A), and an oblique drawing of the antenna apparatus with no dielectric inserted (FIG. 4B)
Figure 4B:
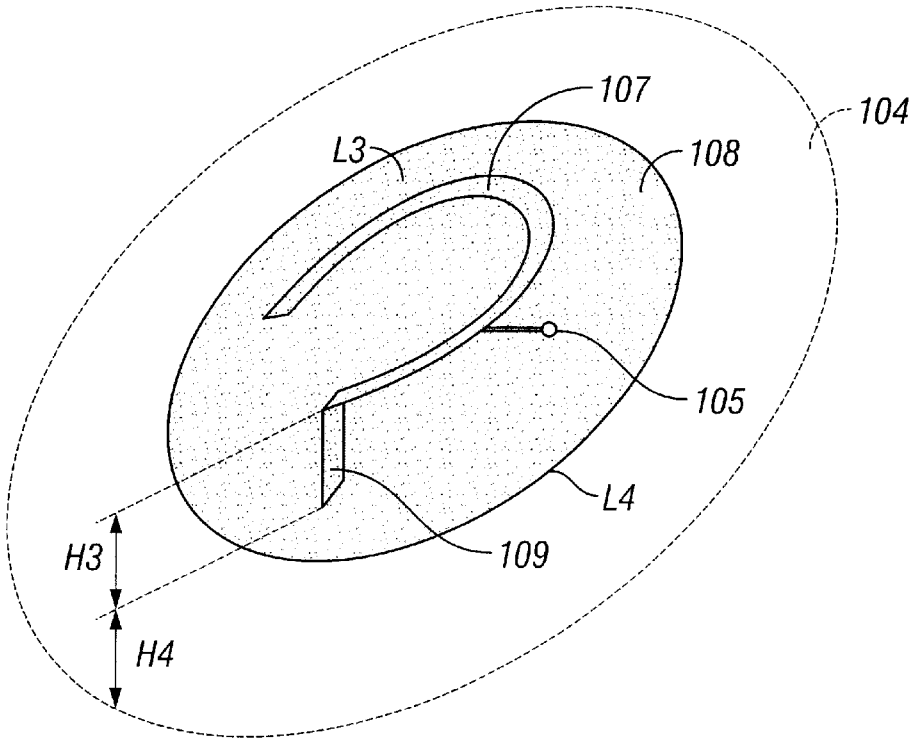

First, the configuration of the antenna apparatus in embodiment 3 will be described with reference to FIGS. 4A and 4B. As will be mentioned later, in the antenna apparatus shown in FIG. 4A, a dielectric 102 is inserted between a spiral radiating element 107 and a circular patch type radiating element 108, whereas a dielectric 102 is not inserted in the antenna apparatus shown in FIG. 4B; the antenna apparatus of the present embodiment below has a configuration in which a dielectric is inserted.

The spiral radiating element 107 is made of metal, and has a feed terminal 105 that is given common termination via a sharing unit (not shown) and is connected to the reception input terminal (not shown) and transmission output terminal (not shown) of a communication apparatus (not shown). The spiral radiating element 107 in embodiment 3 corresponds to the first radiating element of the present invention.

The circular patch type radiating element 108 is made of metal, and is located opposite the spiral radiating element 107. The circular patch type radiating element 108 in embodiment 3 corresponds to the second radiating element of the present invention.

The earth plate 104 is made of metal, and is located on the opposite side to the spiral radiating element 107 with respect to the circular patch type radiating element 108, and opposite the circular patch type radiating element 108. The earth plate 104 is earthed and has an essentially infinite area. The earth plate 104 in embodiment 3 corresponds to the earth of the present invention.

The inductance 109 is a metal tab for connecting the spiral radiating element 107 and the circular patch type radiating element 108, and stabilizing the potential of the spiral radiating element 107.

The dielectric 102 is a part formed from ceramic material that is inserted between the spiral radiating element 107 and circular patch type radiating element 108, and has the function of a spacer. The dielectric 102 also supports the spiral radiating element 107.

In an antenna apparatus in which a dielectric 102 is not inserted (see FIG. 4B), the design parameter standards when the transmission band frequency is 1453 MHz to 1465 MHz and the reception band frequency is 1501 MHz to 1513 MHz are as follows.

The limit of the height H3 of the spiral radiating element 107 with respect to the circular patch type radiating element 108 is about 1/20 of the electric wave wavelength. The limit of the height H4 of the circular patch type radiating element 108 with respect to the earth plate 104 is about 1/60 of the electric wave wavelength. The limit of the length L3 of the spiral radiating element 107 is about ¼ of the electric wave wavelength. The limit of the circumferential length L4 of the circular patch type radiating element 108 is about ½ of the electric wave wavelength.

The operation of the antenna apparatus in embodiment 3 that has this kind of configuration is the same as the operation of the antenna apparatus in embodiment 1.

Figure 8:
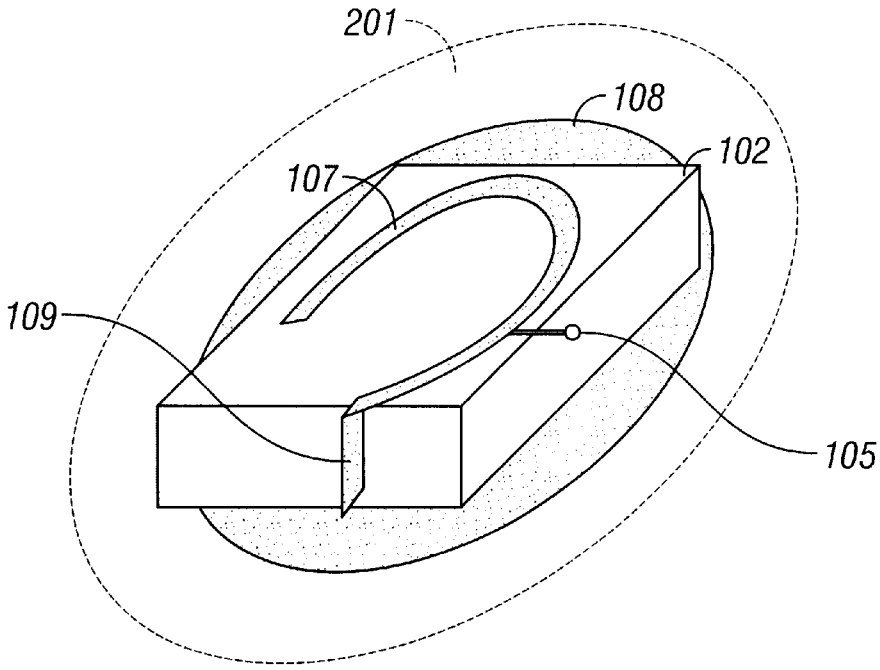
FIG. 8 is an oblique drawing of the antenna apparatus described in embodiment 3 of the present invention.

The earth plate 104 in embodiment 3 need not have an essentially infinite area, and as shown in FIG. 8, need only have an area roughly 3 times or more the area of the circular patch type radiating element 108. FIG. 8 is an oblique drawing of an antenna apparatus that has an earth plate 201 with a finite area.

Figure 12:
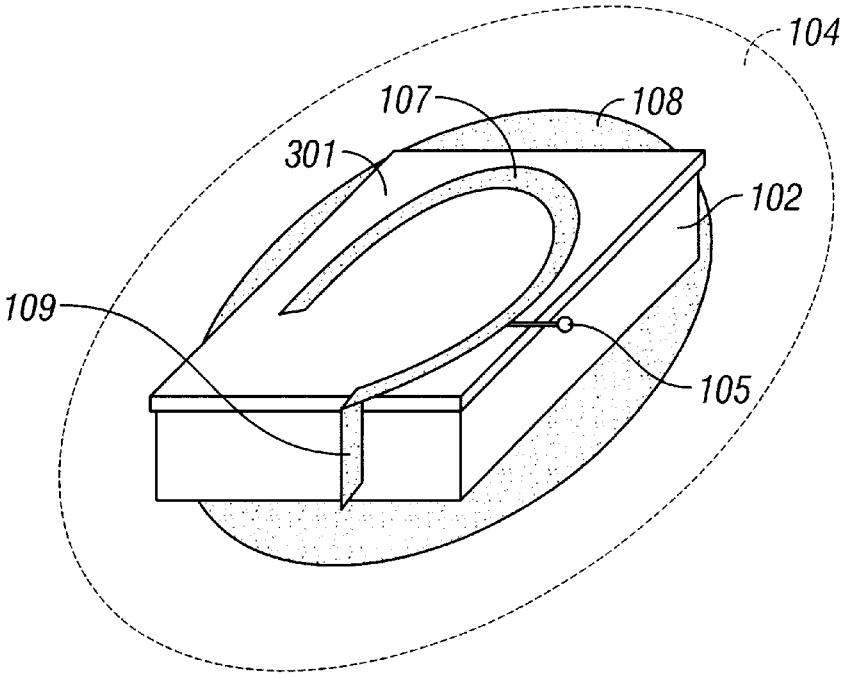
FIG. 12 is an oblique drawing of the antenna apparatus described in embodiment 3 of the present invention.

Also, a printed circuit board 301 such as that shown in FIG. 12 can also be installed between the spiral radiating element 107 and the circular patch type radiating element 108 in embodiment 3, and the spiral radiating element 107 can also be formed on the printed circuit board 301. FIG. 12 is an oblique drawing of an antenna apparatus with a printed circuit board 301 installed.

Embodiment 4

Figure 5A:
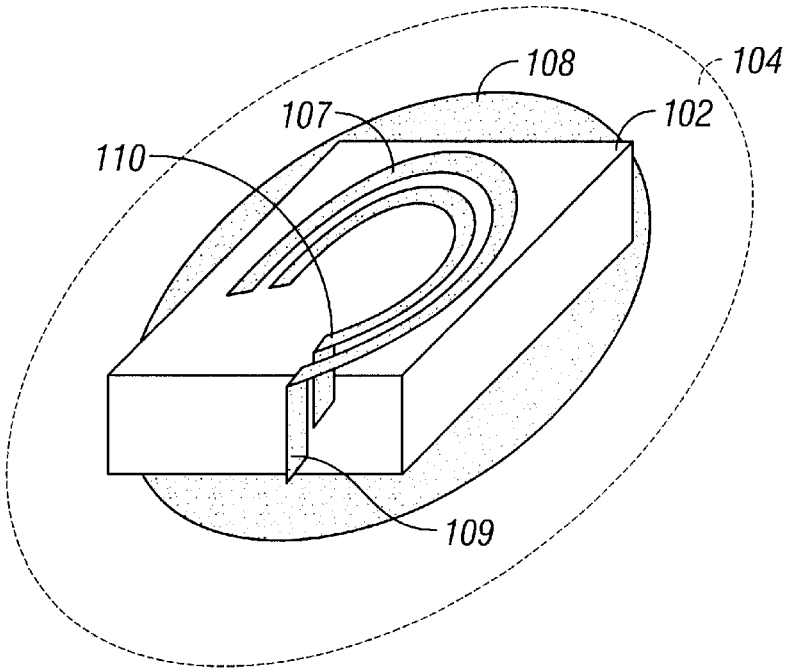
FIG. 5 includes an oblique drawing of the antenna apparatus with dielectric inserted described in embodiment 4 of the present invention (FIG. 5A), and an oblique drawing of the antenna apparatus with no dielectric inserted (FIG. 5B)
Figure 5B:
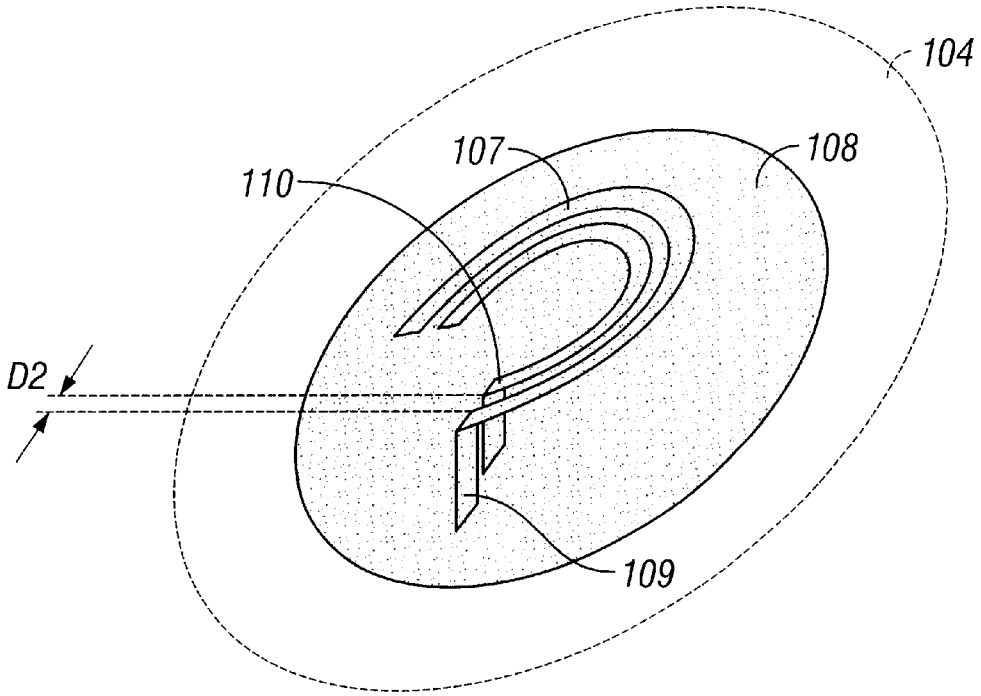

First, the configuration of the antenna apparatus in embodiment 4 will be described with reference to FIGS. 5A and 5B. In the antenna apparatus shown in FIG. 5A, a dielectric 102 is inserted between a spiral radiating element 107 and a circular patch type radiating element 108, whereas such a dielectric is not inserted in the antenna apparatus shown in FIG. 5B; the antenna apparatus of the present embodiment below has a configuration in which a dielectric is inserted.

The antenna apparatus in embodiment 4 differs from the antenna apparatus in embodiment 3 in being equipped with a spiral parasitic element 110, described next.

The spiral parasitic element 110 is a part made of metal that does not have a feed terminal and is fitted parallel to the spiral radiating element 107. As already explained, due to the presence of the spiral parasitic element 110, the gain of the antenna apparatus in embodiment 4 is better than the gain of the antenna apparatus in embodiment 3.

In an antenna apparatus in which a dielectric 102 is not inserted (see FIG. 5B), when the transmission band frequency is 1453 MHz to 1465 MHz and the reception band frequency is 1501 MHz to 1513 MHz, the limit of the gap D2 between the spiral radiating element 107 and the spiral parasitic element 110 is about 1/600 of the electric wave wavelength.

The operation of the antenna apparatus in embodiment 4 that has this kind of configuration is the same as the operation of the antenna apparatus in embodiment 3.

Figure 9:
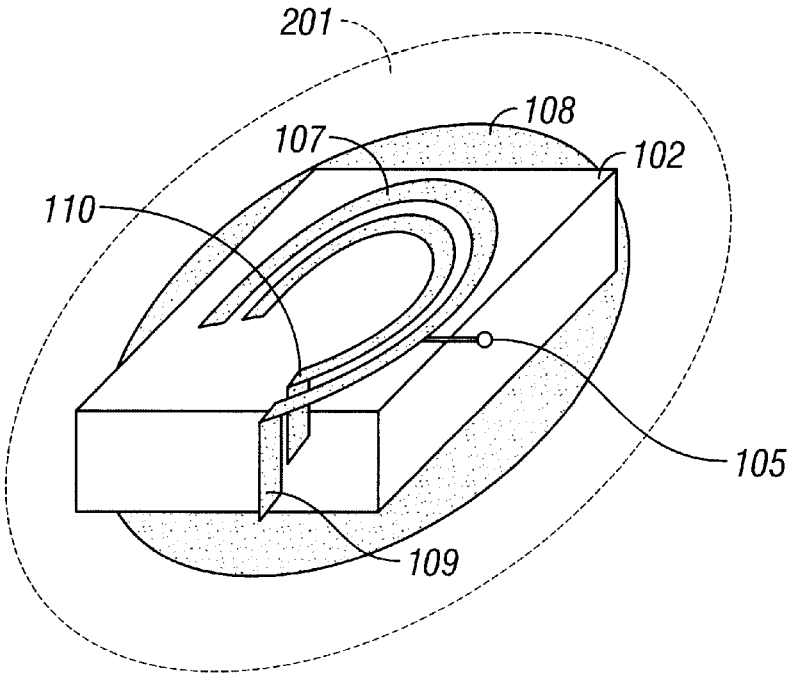
FIG. 9 is an oblique drawing of the antenna apparatus described in embodiment 4 of the present invention.

The earth plate 104 in embodiment 4 need not have an essentially infinite area, and as shown in FIG. 9, need only have an area roughly 3 times or more the area of the circular patch type radiating element 108. FIG. 9 is an oblique drawing of an antenna apparatus that has an earth plate 201 with a finite area.

Figure 13:
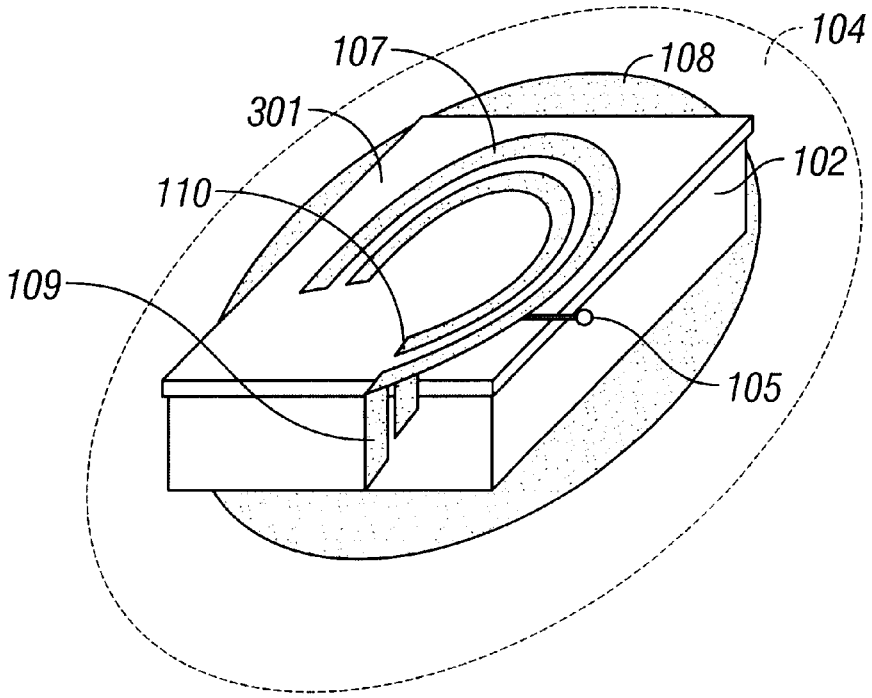
FIG. 13 is an oblique drawing of the antenna apparatus described in embodiment 4 of the present invention.

Also, a printed circuit board 301 such as that shown in FIG. 13 can also be installed between the spiral radiating element 107 and the circular patch type radiating element 108 in embodiment 4, and the spiral radiating element 107 can also be formed on the printed circuit board 301. FIG. 13 is an oblique drawing of an antenna apparatus with a printed circuit board 301 installed.

Embodiment 5

Figure 14A:
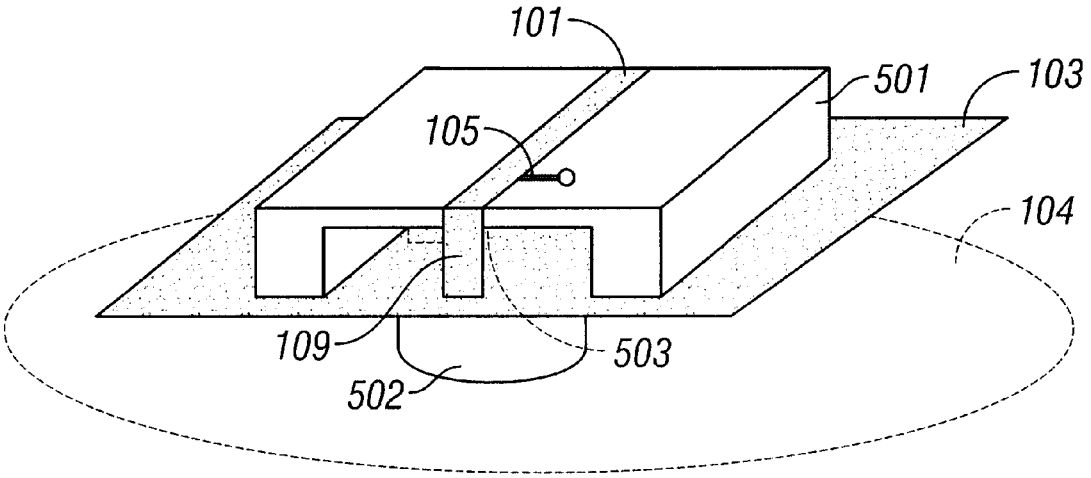
FIG. 14 includes an oblique drawing (FIG. 14A) and a front view (FIG. 14B) of the antenna apparatus described in embodiment 5 of the present invention.
Figure 14B:
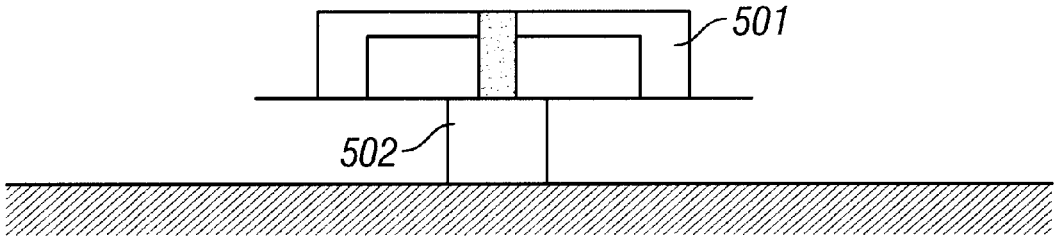

First, the configuration of the antenna apparatus in embodiment 5 will be described with reference to FIGS. 14A and 14B. FIG. 14A is an oblique drawing of the antenna apparatus in embodiment 5, and FIG. 14B is a front view of the antenna apparatus in embodiment 5.

A linear radiating element supporting stand 501 is installed on a patch type radiating element 103, and supports a linear radiating element 101. To prevent the occurrence of disturbance of the electric field, the linear radiating element supporting stand 501 is installed outside the area of opposition 503 of the linear radiating element 101 and the patch type radiating element 103.

A patch type radiating element supporting pillar 502 is installed on the earth plate 104, and supports the linear radiating element 101.

The linear radiating element supporting stand 501 and the patch type radiating element supporting pillar 502 in embodiment 5 corresponds to the supports of the present invention.

The operation of the antenna apparatus in embodiment 5 that has this kind of configuration is the same as the operation of the antenna apparatus in embodiment 1.

Figure 15A:
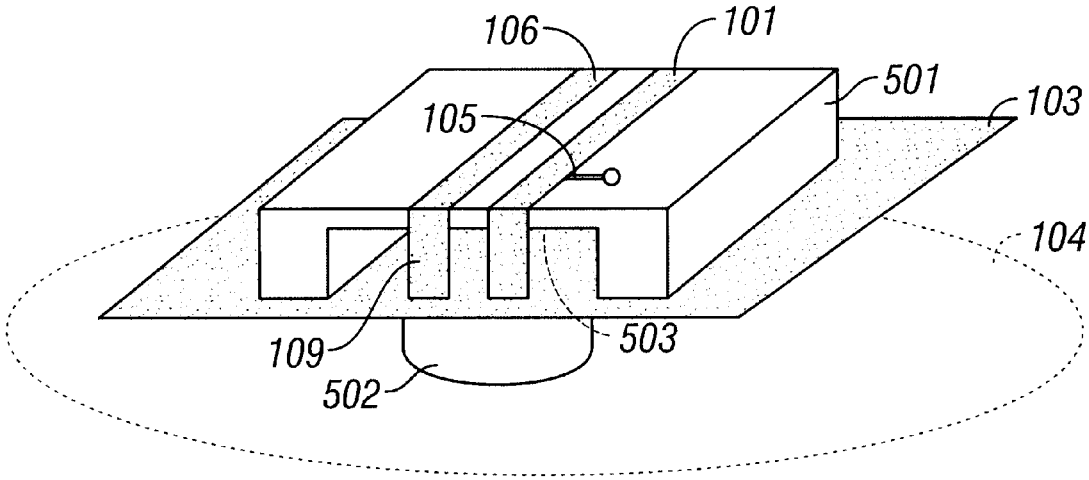
FIG. 15 includes an oblique drawing (FIG. 15A) and a front view (FIG. 15B) of the antenna apparatus described in embodiment 5 of the present invention.
Figure 15B:
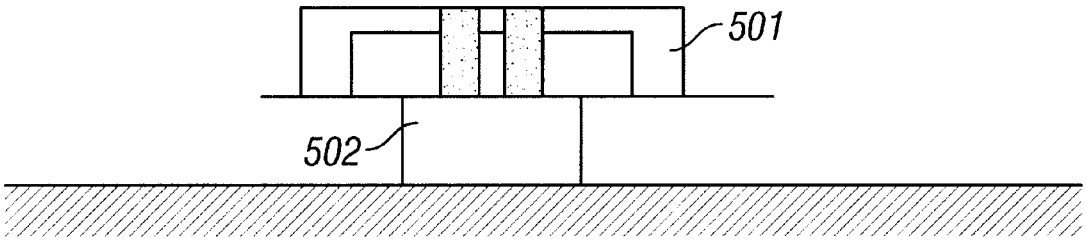

It is also possible for a linear parasitic element 106 to be mounted parallel to the linear radiating element 101 in embodiment 5, as shown in FIG. 15. FIG. 15A is an oblique drawing of an antenna apparatus with a linear parasitic element 106 mounted in parallel, and FIG. 15B is a front view of an antenna apparatus with a linear parasitic element 106 mounted in parallel.

Embodiment 6

Figure 16A:
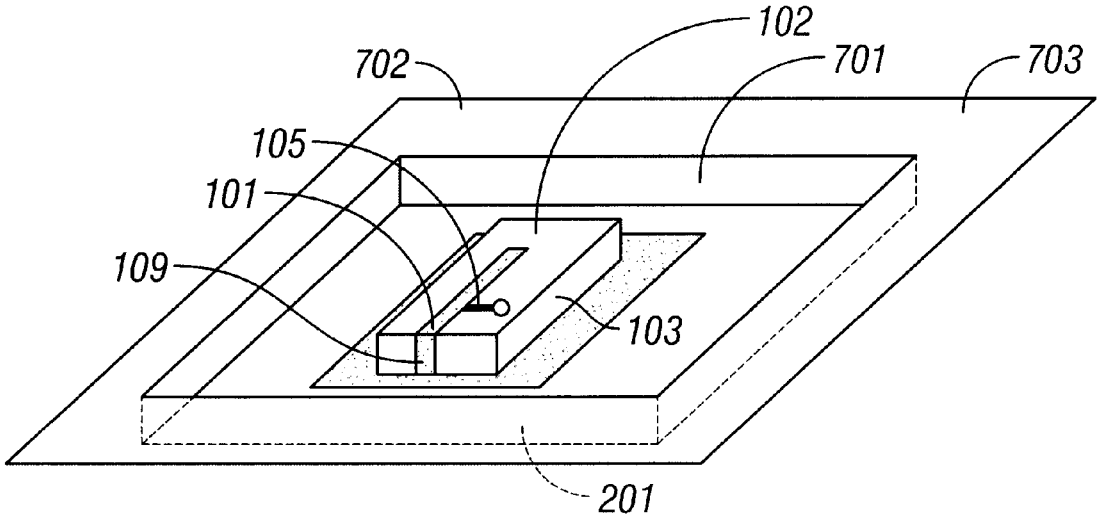
FIG. 16 includes an oblique drawing (FIG. 16A) and cross-sectional drawing (FIG. 16B) of the antenna apparatus described in embodiment 6 of the present invention.
Figure 16B:
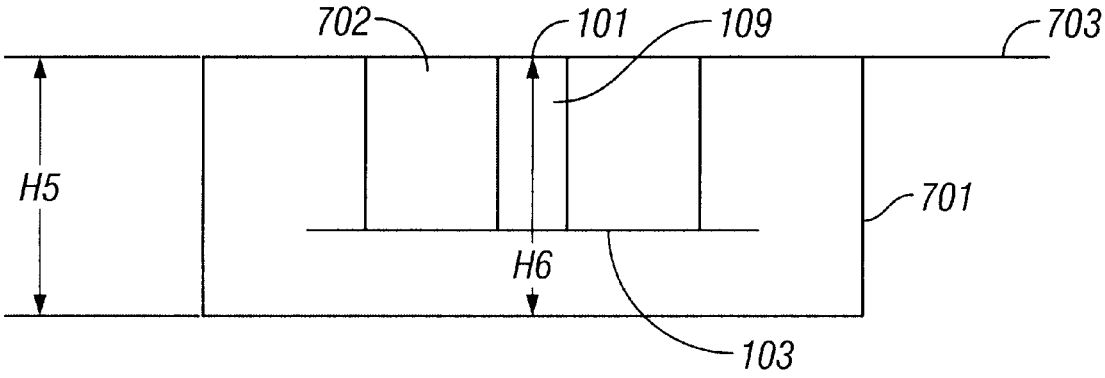

First, the configuration of the antenna apparatus in embodiment 6 will be described with reference to FIGS. 16A and 16B. FIG. 16A is an oblique drawing of the antenna apparatus in embodiment 6, and FIG. 16B is a cross-sectional drawing of the antenna apparatus in embodiment 6. The antenna apparatus in embodiment 6 differs from the antenna apparatus that has an earth plate 201 with a finite area in embodiment 1 in being equipped with a case 701, described next.

The case 701 is integrated with the earth plate 201, and houses the linear radiating element 101 and patch type radiating element 103. The case 701 has an edge 703, the area above which 702 is open. The height H5 of the case 701, as also shown in FIG. 16B, is virtually equal to the height H6 of the linear radiating element 101 with respect to the earth plate 104.

The operation of the antenna apparatus in embodiment 6 that has this kind of configuration is the same as the operation of the antenna apparatus in embodiment 1.

Embodiment 7

Figure 17:
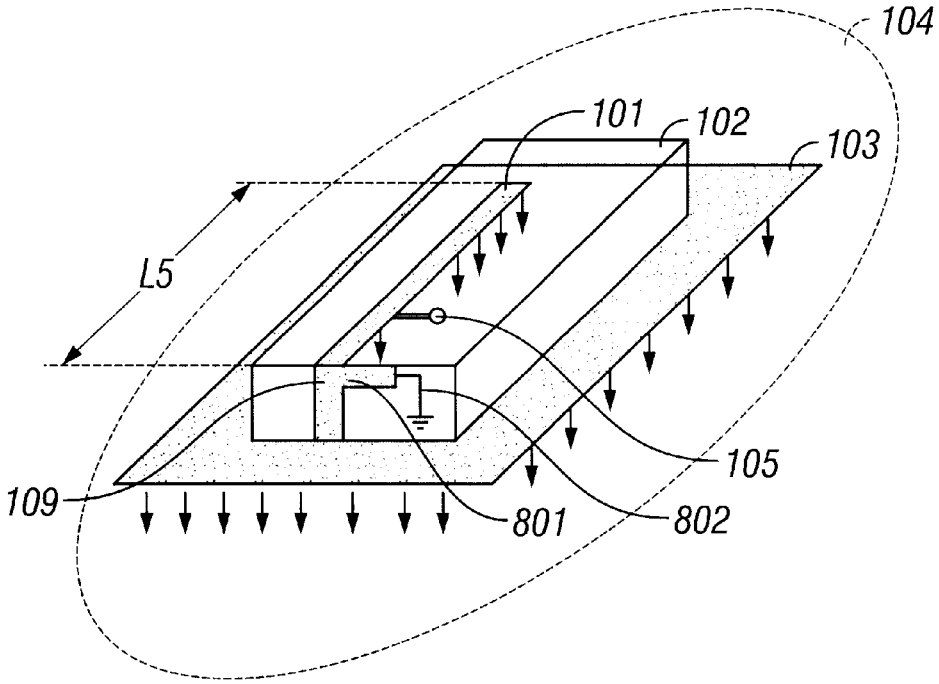
FIG. 17 is an oblique drawing of the antenna apparatus described in embodiment 7 of the present invention.

First, the configuration of the antenna apparatus in embodiment 7 will be described with reference to FIG. 17. FIG. 17 is an oblique drawing of the antenna apparatus in embodiment 7. The antenna apparatus in embodiment 7 differs from the antenna apparatus in embodiment 1 in being equipped with a cable earth 801, described next.

The cable earth 801 is a metal tab, earthed by an earth 802, for stabilizing the potential of the patch type radiating element 103. The cable earth 801 in embodiment 7 corresponds to the earth position determining tab of the present invention. It is sufficient for the length L5 from the cable earth 801 to the front end of the linear radiating element 101 to be about ¼ of the electric wave wavelength. That is to say, as the cable earth 801 is fitted, it is sufficient simply to set the length from there to the front end of the linear radiating element 101 to about ¼ of the electric wave wavelength, thus simplifying the manufacture of an antenna apparatus.

The operation of the antenna apparatus in embodiment 7 that has this kind of configuration is the same as the operation of the antenna apparatus in embodiment 1.

Embodiment 8

Figure 18A:
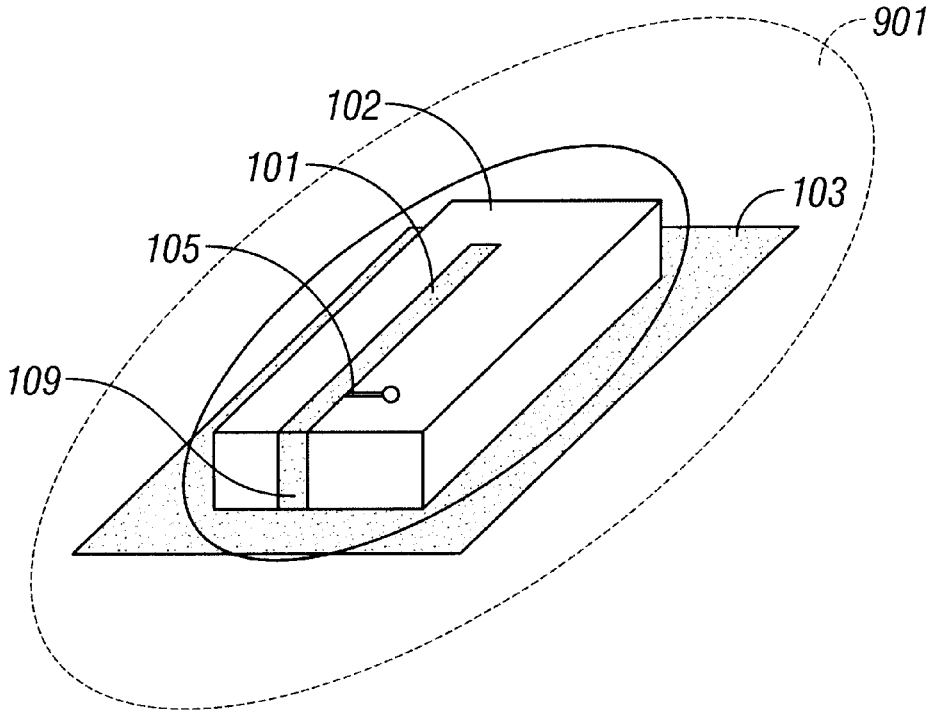
FIG. 18 includes an oblique drawing (FIG. 18A) and cross-sectional drawing (FIG. 18B) of the antenna apparatus described in embodiment 8 of the present invention.
Figure 18B:
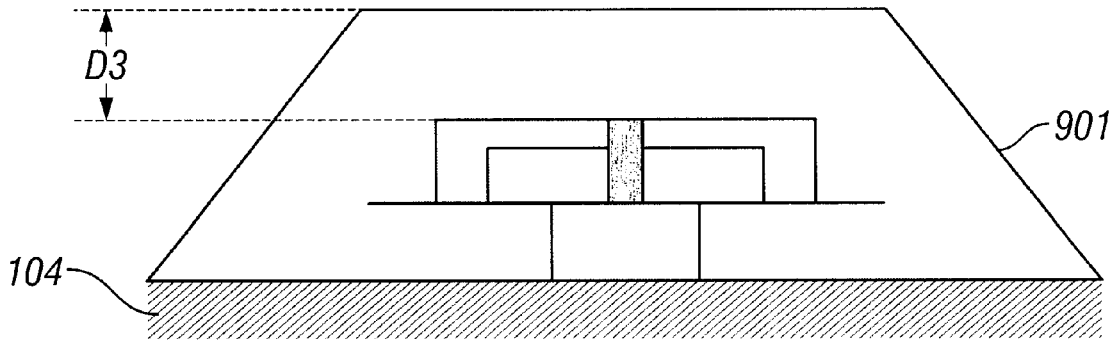

First, the configuration of the antenna apparatus in embodiment 8 will be described with reference to FIGS. 18A and 18B. FIG. 18A is an oblique drawing of the antenna apparatus in embodiment 8, and FIG. 18B is a cross-sectional drawing of the antenna apparatus in embodiment 8. The antenna apparatus in embodiment 8 differs from the antenna apparatus in embodiment 5 in being equipped with a cover 901, described next.

The cover 901 covers the linear radiating element 101, patch type radiating element 103, and earth plate 104, and is formed from ABS. The size D3 of the space between the cover 901 and the linear radiating element 101 should preferably be about 1/60 of the electric wave wavelength or more; tuning frequency drift is avoided by this means. The cover 901 also protects the linear radiating element 101, patch type radiating element 103, and earth plate 104.

The operation of the antenna apparatus in embodiment 8 that has this kind of configuration is the same as the operation of the antenna apparatus in embodiment 5.

Embodiment 9

Figure 19A:
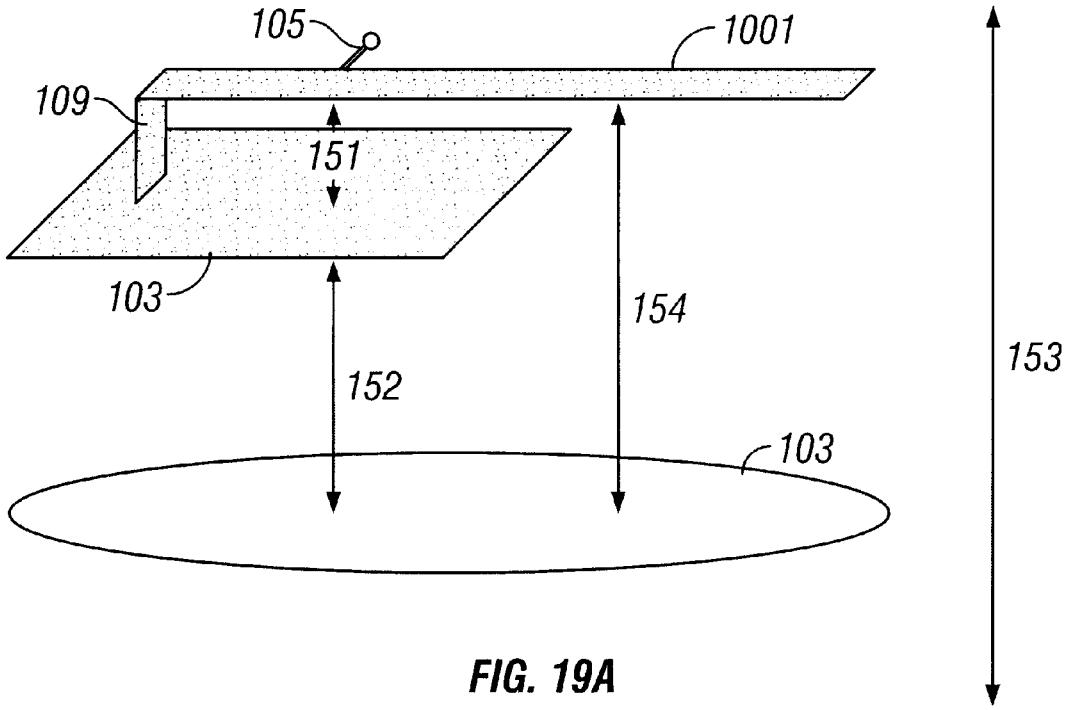
FIG. 19 includes an oblique drawing (FIG. 19A) and front view (FIG. 19B) of the antenna apparatus described in embodiment 9 of the present invention.
Figure 19B:
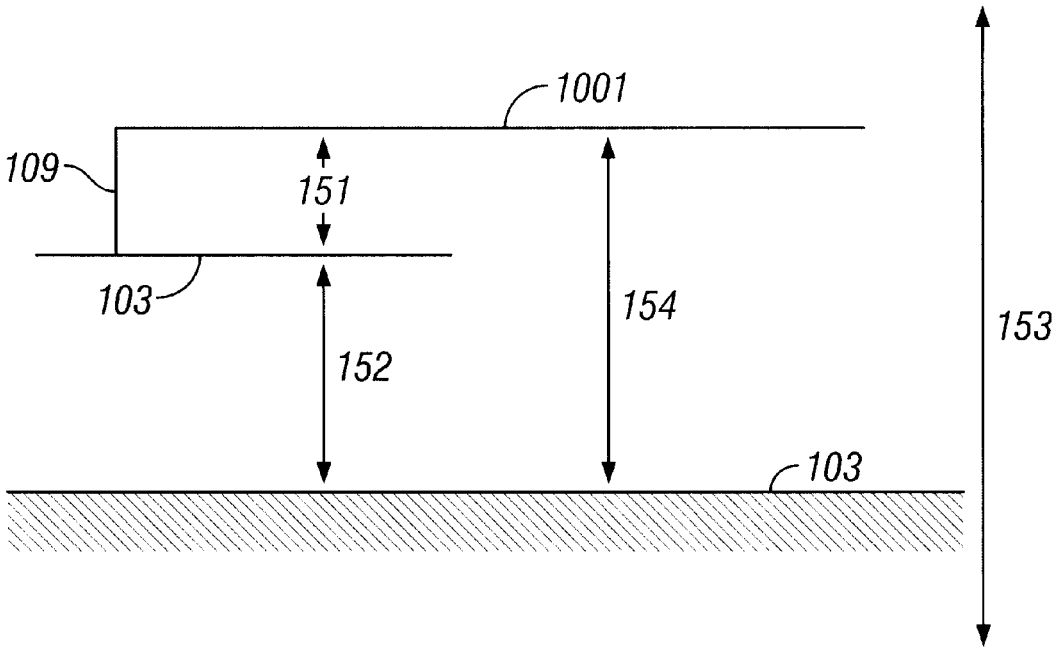
Figure 20:
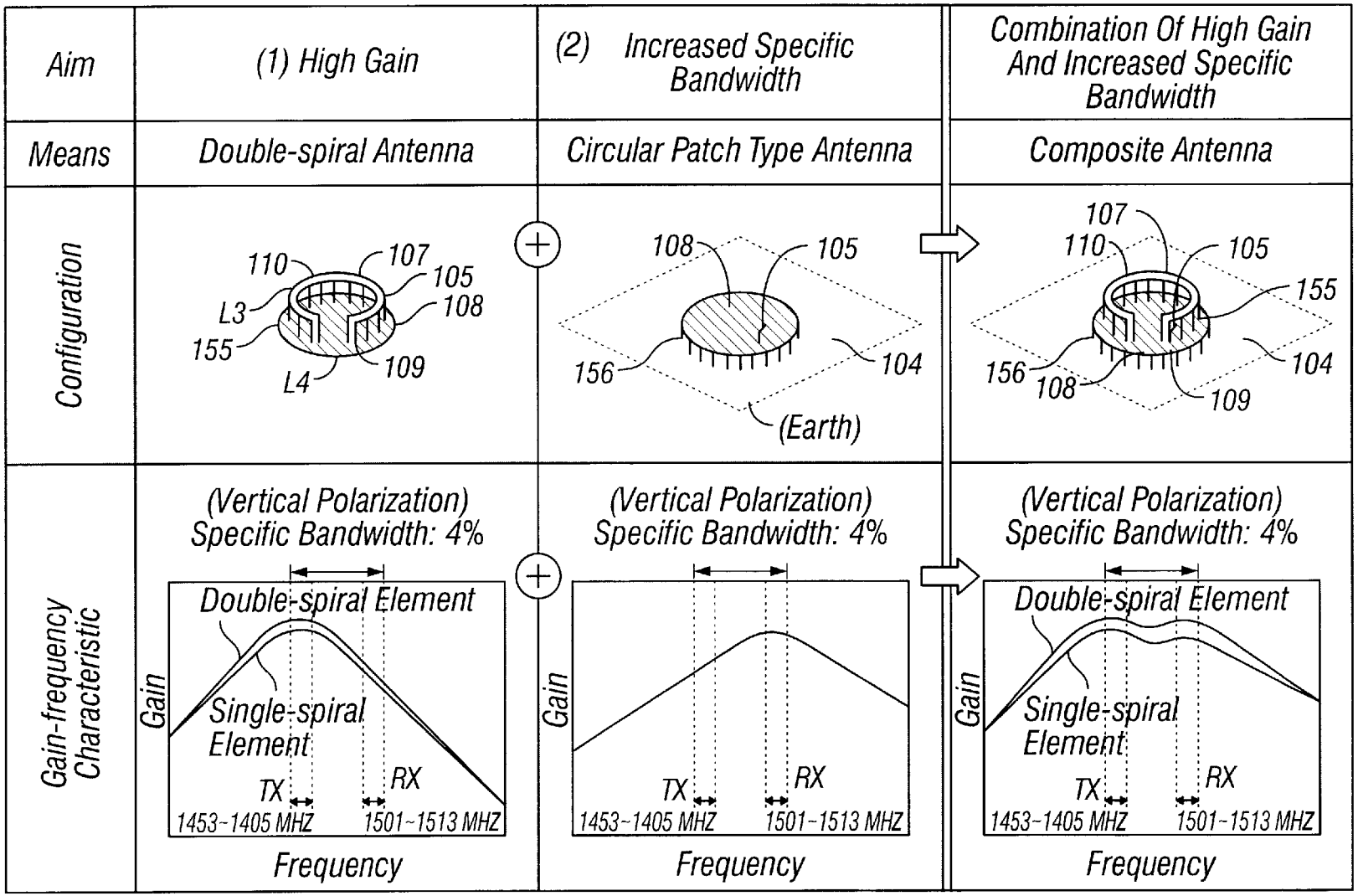
FIG. 20 is a conceptual diagram providing comparative descriptions of antennas according to the prior art and the antenna of the present invention.
Figure 21:
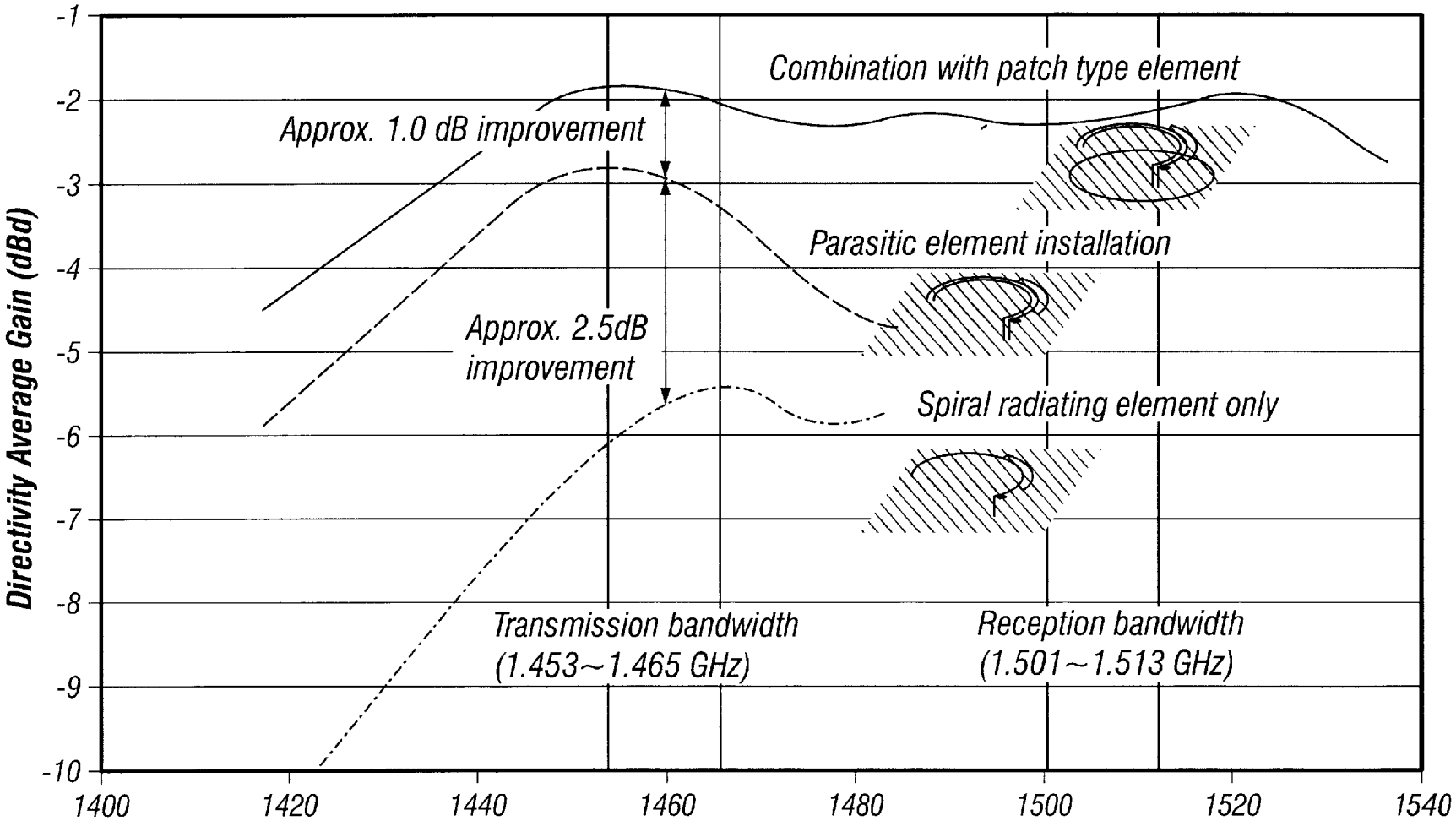
FIG. 21 is a conceptual diagram providing comparative descriptions of the performance characteristics of antennas according to the prior art and the antenna of the present invention.

First, the configuration of the antenna apparatus in embodiment 9 will be described with reference to FIGS. 19A and 19B. FIG. 19A is an oblique drawing of the antenna apparatus in embodiment 9, and FIG. 19B is a front view of the antenna apparatus in embodiment 9. The antenna apparatus in embodiment 9 differs from the antenna apparatus in embodiment 1 in being equipped with a linear radiating element 1001 that extends beyond the patch type radiating element 103.

The linear radiating element 1001 extends beyond the patch type radiating element 103 as shown in FIG. 19. For this reason, the electric field 154 described later can be used for electric wave transmission and reception. The linear radiating element 1001 in embodiment 9 corresponds to the first radiating element of the present invention.

The operation of the antenna apparatus in embodiment 9 that has this kind of configuration will now be described with reference to FIG. 19. As the reception operation of the antenna apparatus in embodiment 9 is understood as virtually the opposite of the transmission operation described below, only the transmission operation will be described below.

The transmission output terminal (not shown) of the communication apparatus (not shown) performs signal output to the linear radiating element 1001 via the feed terminal 105

Due to the above described signal output from the communication apparatus (not shown), an electric field 151 is generated between the linear radiating element 1001 and the patch type radiating element 103, and an electric field 152 is generated between the patch type radiating element 103 and the earth plate 104. Also, an electric field 154 is generated between the linear radiating element 1001 and the earth plate 104. Thus, in embodiment 9, an electric field 154 is also generated between the linear radiating element 1001 and the earth plate 104.

The electric field 153 which is the composite sum of electric field 151, electric field 152, and electric field 154, is sent as the transmission electric wave.

Embodiment 10

Figure 22A:
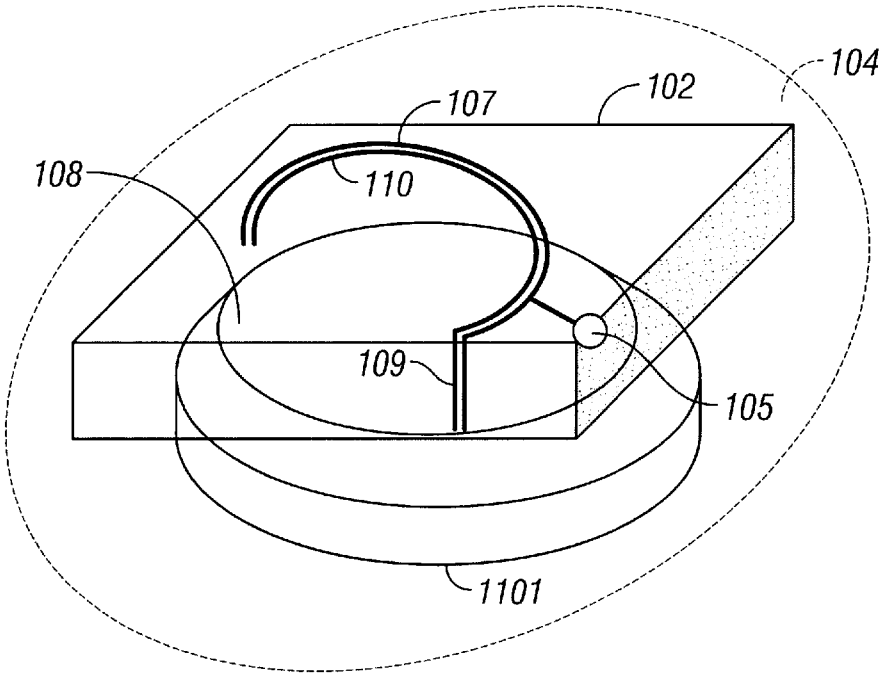
FIG. 22 includes an oblique drawing of the antenna apparatus with dielectric inserted described in embodiment 10 of the present invention (FIG. 22A), and an oblique drawing of the antenna apparatus with no dielectric inserted (FIG. 22B)
Figure 22B:
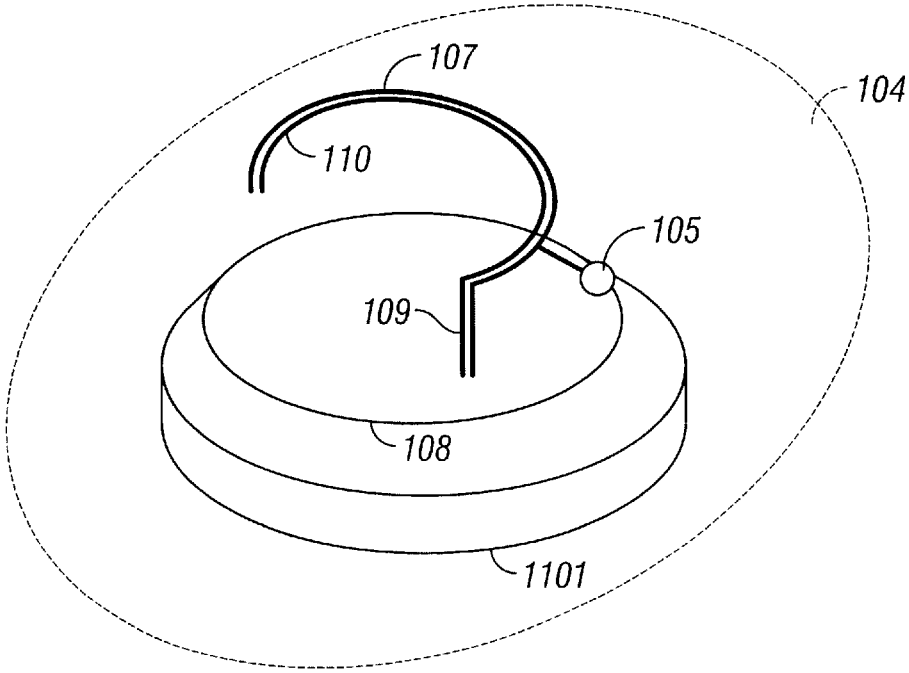

First, the configuration of the antenna apparatus in embodiment 10 will be described with reference to FIGS. 22A and 22B. In the antenna apparatus shown in FIG. 22A, a dielectric 102 is inserted between a spiral radiating element 107 and a circular patch type radiating element 108, whereas such a dielectric is not inserted in the antenna apparatus shown in FIG. 22B; the antenna apparatus of the present embodiment below has a configuration in which a dielectric is inserted.

The antenna apparatus in embodiment 10 differs from the antenna apparatus in embodiment 4 in being equipped with a metal pedestal 1101, described next.

The metal pedestal 1101 is located between the circular patch type radiating element 108 and the earth plate 104, and is in contact with the earth plate 104 but is not in contact with the circular patch type radiating element 108. The metal pedestal 101 contacts the earth plate 104 by means of a magnet, etc., and can easily be attached to and detached from the earth plate 104. The spiral radiating element 107, spiral parasitic element 110, circular patch type radiating element 108, and feed terminal 105 are integrated with the metal pedestal 1101, and together with the metal pedestal 1101 configure an antenna apparatus that can easily be moved from place to place. (Also, by inserting insulating material between the circular patch type radiating element 108 and the metal pedestal 1101, the circular patch type radiating element 108 can be kept essentially out of contact with the metal pedestal 1101.)

The metal pedestal 1101 is an electric conductor. Therefore, through the contact between the metal pedestal 1101 and the earth plate 104, the metal pedestal 1101 functions effectively as an earth for the spiral radiating element 107 and circular patch type radiating element 108.

Here, the side of the dielectric 102 toward the spiral radiating element 107 is in contact with the spiral radiating element 107, and the side of the dielectric 102 toward the circular patch type radiating element 108 is in contact with the circular patch type radiating element 108. By inserting insulating material between the spiral radiating element 107 and the circular patch type radiating element 108 in this way, the height of the antenna apparatus is kept low, and the spiral radiating element 107 is conveniently supported. The spiral radiating element 107 and circular patch type radiating element 108 may also be contained within the dielectric 102.

The operation of the antenna apparatus in embodiment 10 that has this kind of configuration is the same as the operation of the antenna apparatus in embodiment 4.

Embodiment 11

Figure 23A:
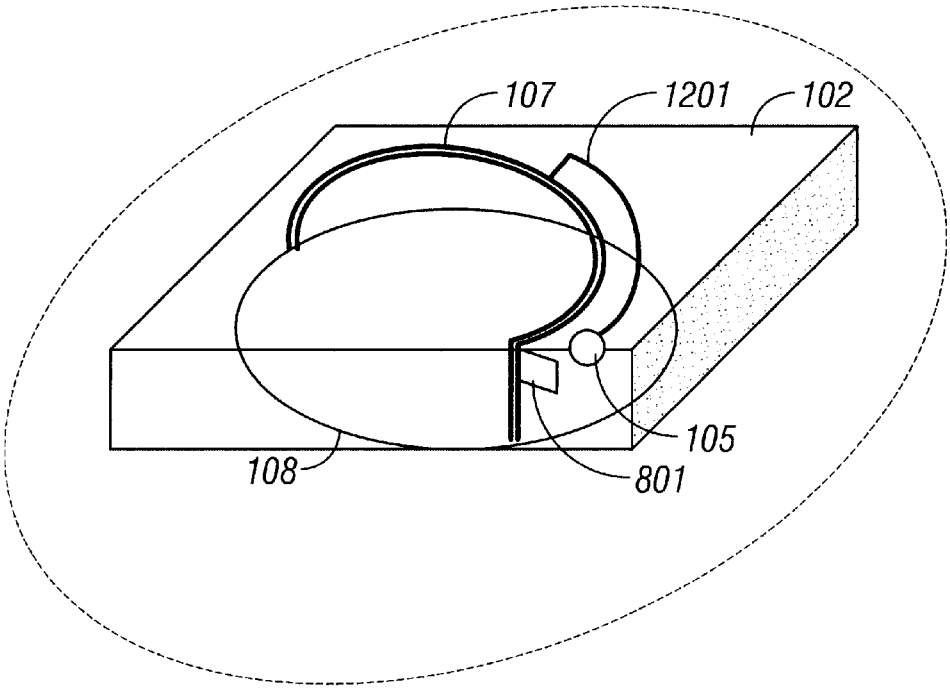
FIG. 23 includes an oblique drawing of the antenna apparatus with dielectric inserted described in embodiment 11 of the present invention (FIG. 23A), and an oblique drawing of the antenna apparatus with no dielectric inserted (FIG. 23B)
Figure 23B:
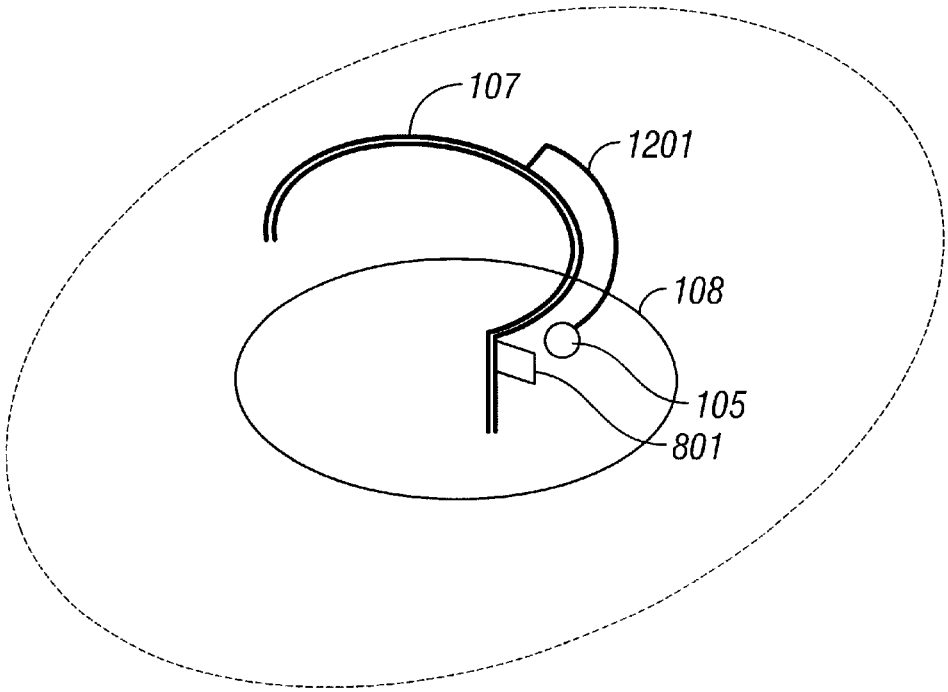

First, the configuration of the antenna apparatus in embodiment 11 will be described with reference to FIGS. 23A and 23B. In the antenna apparatus shown in FIG. 23A, a dielectric 102 is inserted between a spiral radiating element 107 and a circular patch type radiating element 108, whereas such a dielectric is not inserted in the antenna apparatus shown in FIG. 23B; the antenna apparatus of the present embodiment below has a configuration in which a dielectric is inserted.

The antenna apparatus in embodiment 11 differs from the antenna apparatus in embodiment 7 in being equipped with a feeder line 1201.

The feeder line 1201 is a line for extending the feed terminal 105 up to the vicinity of the cable earth 801. Providing the feeder line 1201 enables the antenna apparatus to be easily connected to the communication apparatus (not shown).

When the antenna apparatus is connected to the communication apparatus (not shown) by means of a coaxial cable. (not shown), the cable ground of the coaxial cable is connected to the cable earth 801, and the coaxial cable signal line is connected to the feed terminal 105.

The operation of the antenna apparatus in embodiment 11 that has this kind of configuration is the same as the operation of the antenna apparatus in embodiment 7.

Embodiment 12

Figure 24A:
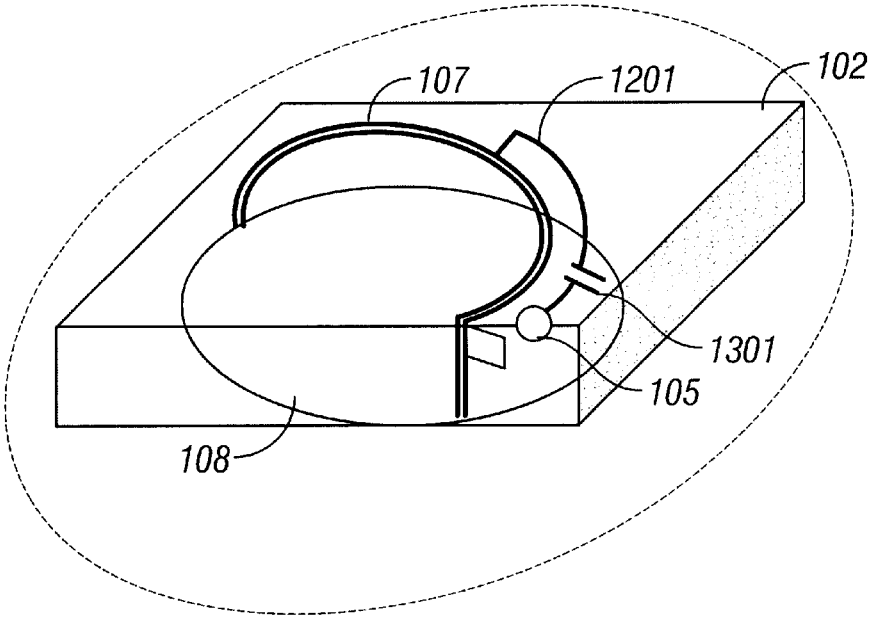
FIG. 24 includes an oblique drawing of the antenna apparatus with dielectric inserted described in embodiment 12 of the present invention (FIG. 24A), and an oblique drawing of the antenna apparatus with no dielectric inserted (FIG. 24B)
Figure 24B:
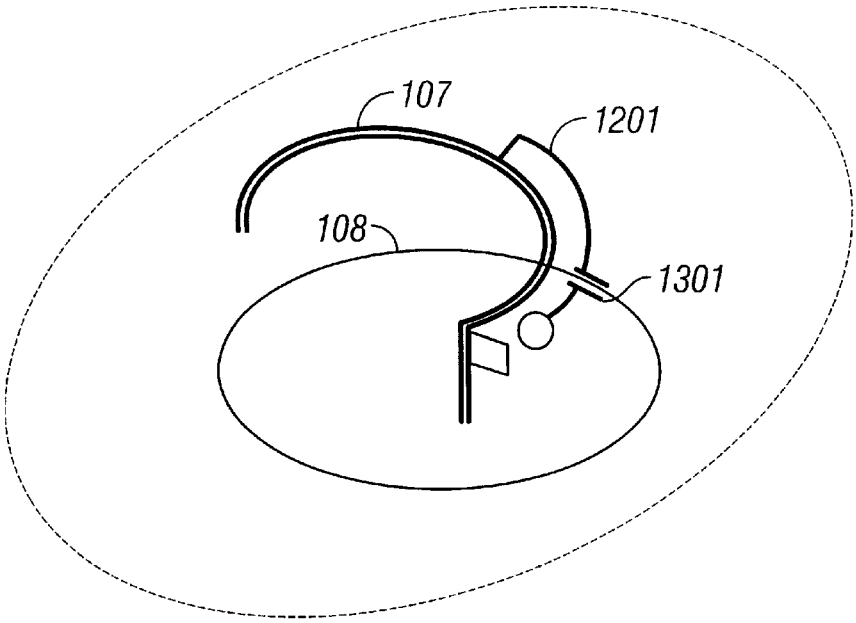

First, the configuration of the antenna apparatus in embodiment 12 will be described with reference to FIGS. 24A and 24B. In the antenna apparatus shown in FIG. 24A, a dielectric 102 is inserted between a spiral radiating element 107 and a circular patch type radiating element 108, whereas such a dielectric is not inserted in the antenna apparatus shown in FIG. 24B; the antenna apparatus of the present embodiment below has a configuration in which a dielectric is inserted.

The antenna apparatus in embodiment 12 differs from the antenna apparatus in embodiment 11 in being equipped with a capacitor 1301.

The capacitor 1301 is connected between the feeder line 1201 and the coaxial cable signal line (as described in embodiment 11, the cable ground of the coaxial cable is connected to the cable earth, and the coaxial cable signal line is connected to the feed terminal). By connecting the capacitor, it is possible to cancel the reactance component generated by the feeder line and to measure only the actual impedance component, making it easy to achieve antenna impedance matching.

The operation of the antenna apparatus in embodiment 12 that has this kind of configuration is the same as the operation of the antenna apparatus in embodiment 1.

Embodiment 13

Figure 25A:
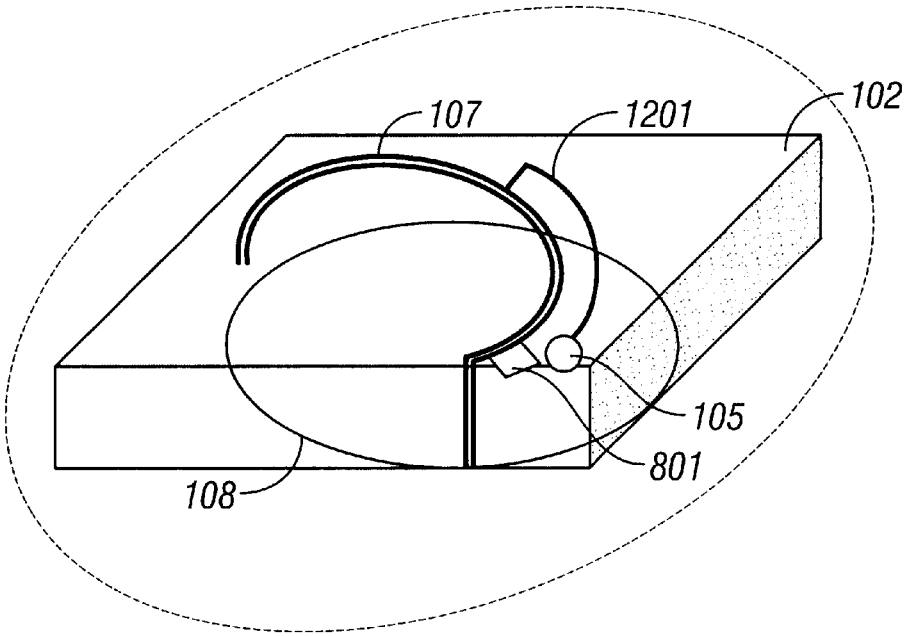
FIG. 25 includes an oblique drawing of the antenna apparatus with dielectric inserted described in embodiment 13 of the present invention (FIG. 25A), and an oblique drawing of the antenna apparatus with no dielectric inserted (FIG. 25B)
Figure 25B:
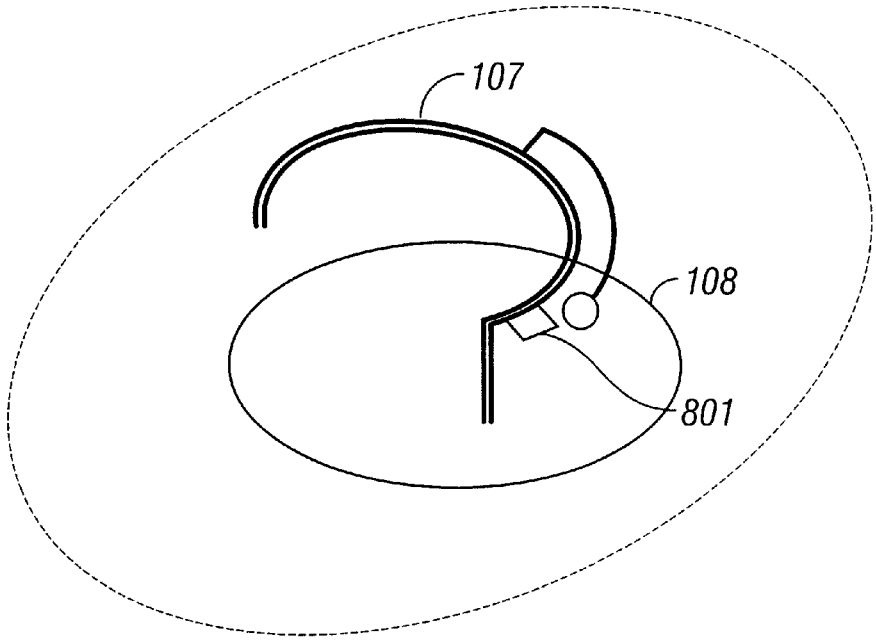

First, the configuration of the antenna apparatus in embodiment 13 will be described with reference to FIGS. 25A and 25B. In the antenna apparatus shown in FIG. 25A, a dielectric 102 is inserted between a spiral radiating element 107 and a circular patch type radiating element 108, whereas such a dielectric is not inserted in the antenna apparatus shown in FIG. 25B; the antenna apparatus of the present embodiment below has a configuration in which a dielectric is inserted.

The antenna apparatus in embodiment 13 differs from the antenna apparatus in embodiment 11 with respect to equipped position of a cable earth 801 described next.

By positioning the cable earth 801 at the same level as the spiral radiating element 107, it is possible to position the feed section of the feeder line 1201 and the cable earth 801 at the same level. As a result, the part bent at a right angle between the spiral radiating element 107 and the cable earth is eliminated, enabling the current loss due to bending of the element to be made small.

The operation of the antenna apparatus in embodiment 13 that has this kind of configuration is the same as the operation of the antenna apparatus in embodiment 11.

Embodiment 14

Figure 26A:
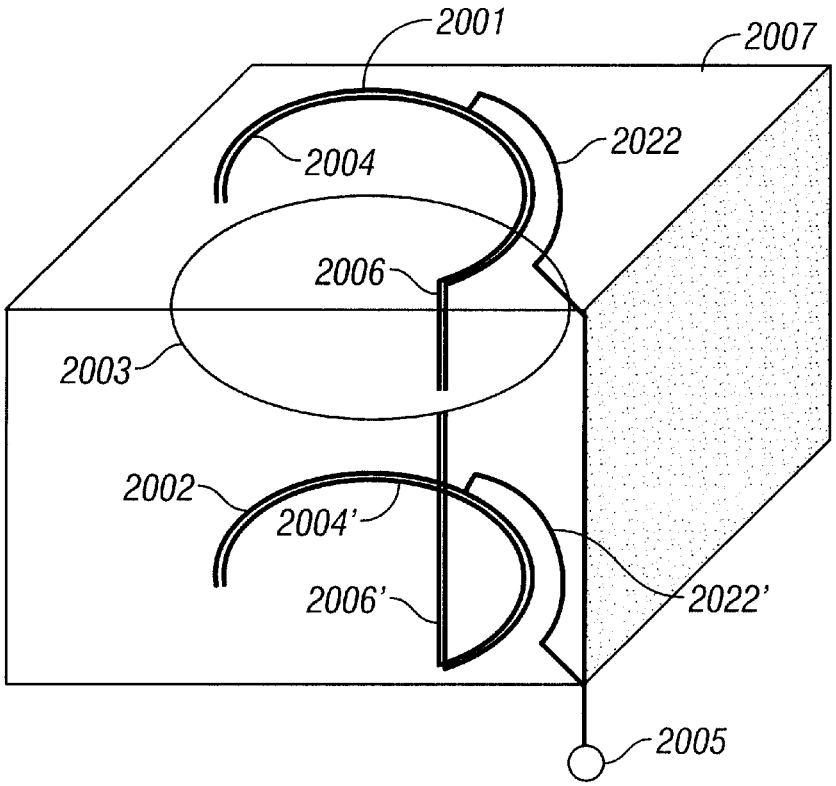
FIG. 26 includes an oblique drawing of the antenna apparatus with dielectric inserted described in embodiment 14 of the present invention (FIG. 26A), and an oblique drawing of the antenna apparatus with no dielectric inserted (FIG. 26B)
Figure 26B:
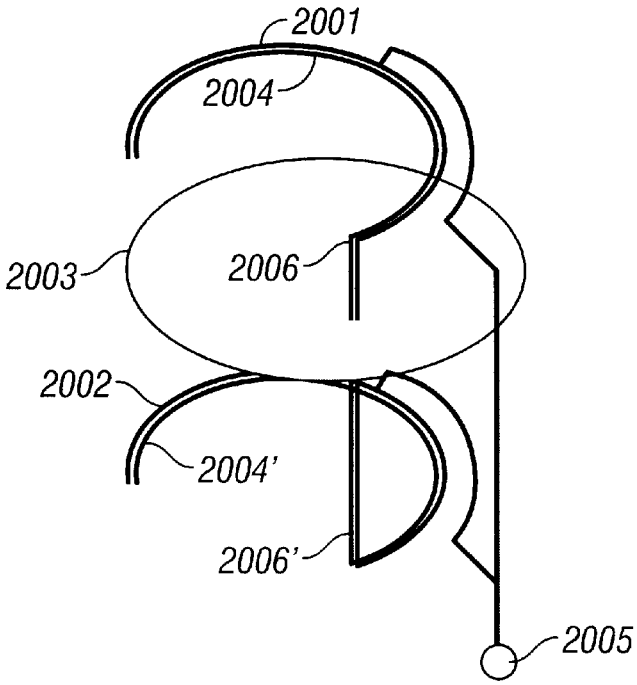

First, the configuration of the antenna apparatus in embodiment 14 will be described with reference to FIGS. 26A and 26B. In the antenna apparatus shown in FIG. 26A, a dielectric 2007 is inserted between (1) a first spiral radiating element 2001 and a spiral parasitic element 2004 installed parallel to the first spiral radiating element 2001, and (2) a second spiral radiating element 2002 and a spiral parasitic element 2004' installed parallel to the second spiral radiating element 2002, whereas such a dielectric is not inserted in the antenna apparatus shown in FIG. 26B; the antenna apparatus of the present embodiment below has a configuration in which a dielectric is inserted.

The first spiral radiating element 2001 and second spiral radiating element 2002 are both made of metal, and have a feed terminal 2005 that is given common termination via a sharing unit (not shown) and is connected to the reception input terminal (not shown) and transmission output terminal (not shown) of a communication apparatus (not shown).

Common feeding to the first spiral radiating element 2001 and second spiral radiating element 2002 is performed from the feed terminal 2005. The second spiral radiating element 2002 is located on the opposite side to the first spiral radiating element 2001 with respect to a circular patch type element 2003 made of metal, and is located opposite the circular patch type element 2003.

The first spiral radiating element 2001 corresponds to the first radiating element of the present invention, and the second spiral radiating element 2002 corresponds to the third radiating element of the present invention. The circular patch type element 2003 corresponds to the second radiating element of the present invention.

As in embodiment 1, an inductance 2006 connects the first spiral radiating element 2001 and the circular patch type element 2003, and an inductance 2006' connects the second spiral radiating element 2002 and the circular patch type element 2003. These are metal tabs for stabilizing the potential of the first spiral radiating element 2001 and second spiral radiating element 2002.

The dielectric 2007 is a part formed from ceramic material that is inserted between (1) the first spiral radiating element 2001 and the spiral parasitic element 2004 installed parallel to the first spiral radiating element 2001, and (2) the second spiral radiating element 2002 and the spiral parasitic element 2004' installed parallel to the second spiral radiating element 2002, and has the function of a spacer. The dielectric 2007 also supports the first spiral radiating element 2001 and second spiral radiating element 2002.

A first feeder line 2022 is connected to the first spiral radiating element 2001, and a second feeder line 2022' is connected to the second spiral radiating element 2002; common feeding to these is performed from the feed terminal 2005.

Figure 27:
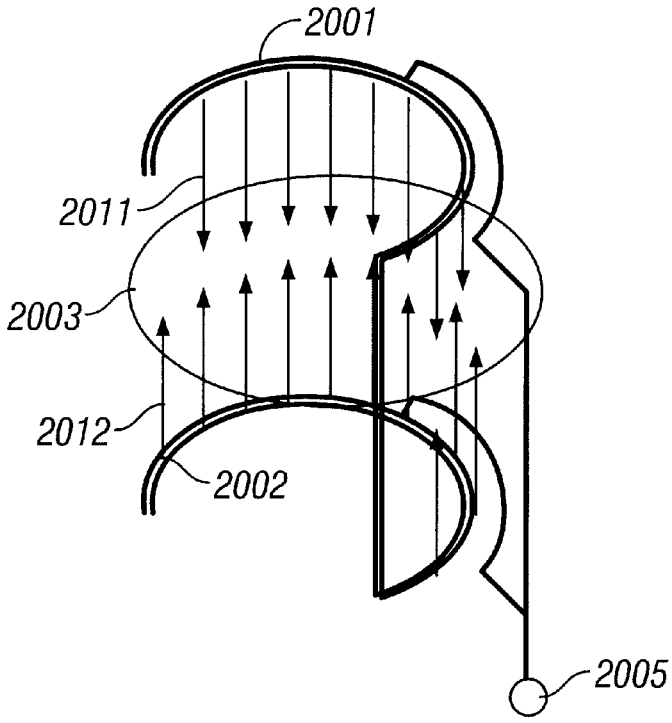
FIG. 27 is a type drawing for explaining the transmission operation of the antenna apparatus in embodiment 14 of the present invention.

The operation of the antenna apparatus in embodiment 14 that has this kind of configuration will now be described with reference to FIG. 27. FIG. 27 is a type drawing for explaining the transmission operation of the antenna apparatus in embodiment 14. As the reception operation of the antenna apparatus in embodiment 14 is understood as virtually the opposite of the transmission operation described below, only the transmission operation will be described below.

The communication apparatus (not shown) performs the same kind of signal output as in embodiment 1 to the first spiral radiating element 2001 and the second spiral radiating element 2002 via the feed terminal 2005.

Due to the above described signal output from the communication apparatus (not shown), an electric field 2011 is generated between the first spiral radiating element 2001 and the circular patch type element 2003. Also, due to the above described signal output from the communication apparatus (not shown), an electric field 2012 is generated between the second spiral radiating element 2002 and the circular patch type element 2003. However, as, unlike embodiment 1, there is no earth opposite the circular patch type element 2003, there is no electric field radiated from the circular patch type element 2003.

In this way the generated electric fields 2011 and 2012 are combined and sent as the transmission electric wave.

Figure 28A:
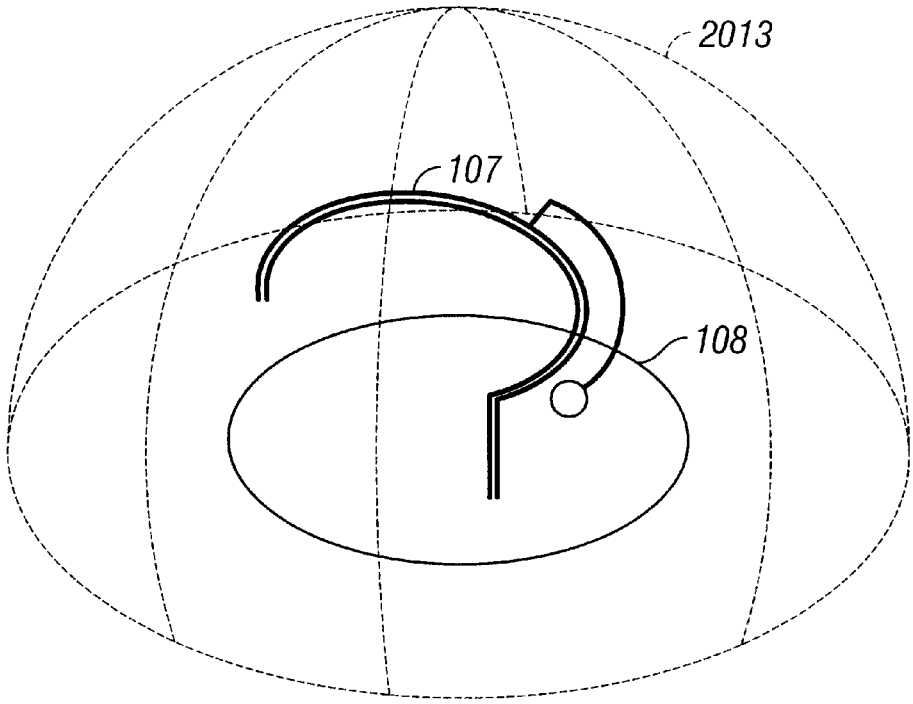
FIG. 28 includes a schematic drawing for explaining the directivity of the antenna apparatus in embodiments 1 to 13 of the present invention (FIG. 28A), and a schematic drawing for explaining the directivity of the antenna apparatus in embodiments 14 to 16 of the present invention (FIG. 28B)

Here, the directivity of the antenna apparatus of embodiment 14 will be described using FIGS. 28A and 28B. FIG. 28A is a schematic drawing for explaining the directivity of the antenna apparatus in embodiments 1 to 13, and FIG. 28B is a schematic drawing for explaining the directivity of the antenna apparatus in embodiments 14 to 16.

Figure 28B:
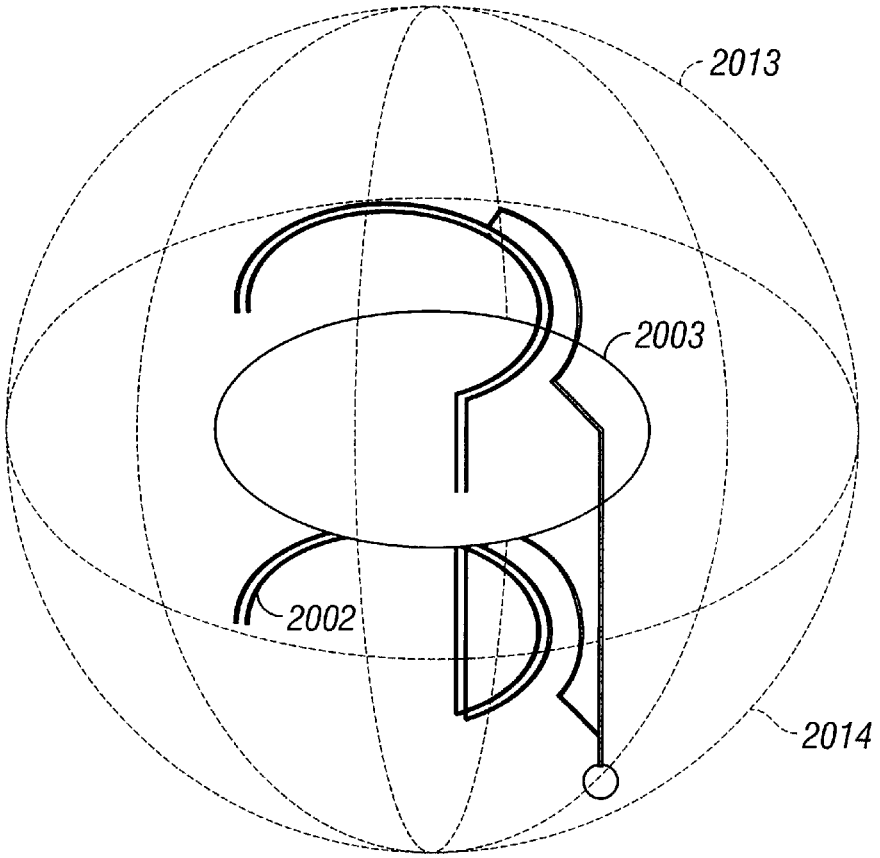

Due to electric field 2011 (see FIG. 27), hemispherical directivity 2013 (see FIGS. 28A and 28B) is obtained, and, since the directivity 2014 (see FIG. 28B) obtained due to the electric field 2012 (see FIG. 27) between the second spiral radiating element 2002 and the circular patch type element 2003 is also hemispherical, the antenna directivity obtained as a combination of these consists of directivity 2013 together with directivity 2014, forming a sphere as shown in FIG. 28B. As a result, it is possible to realize an antenna apparatus that has high gain in all the directions from which electric waves arrive.

Embodiment 15

Figure 29A:
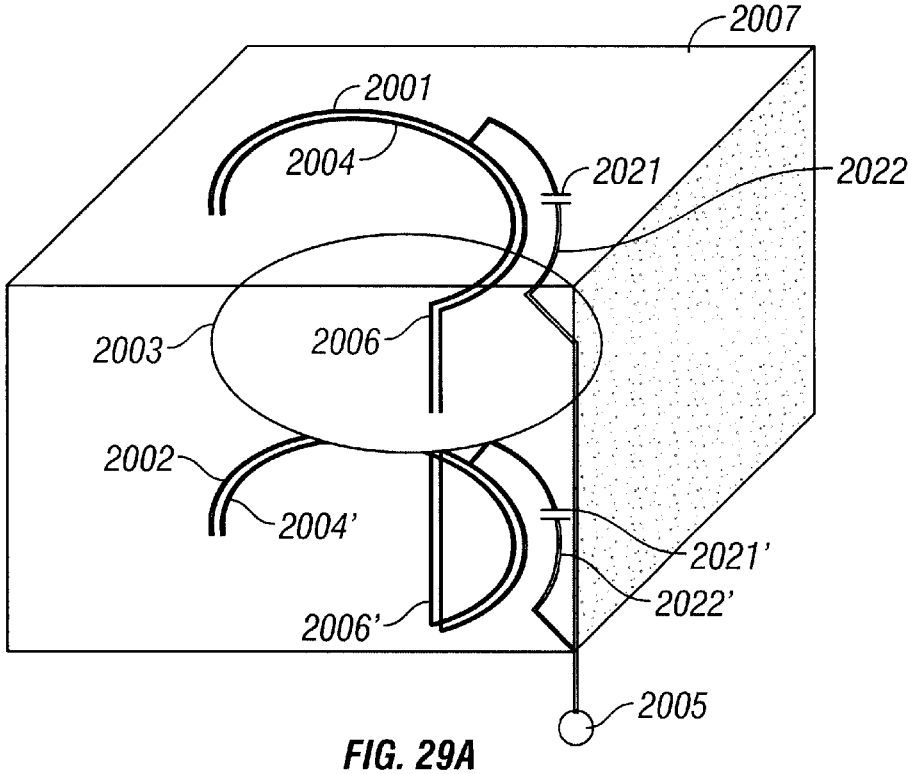
FIG. 29 includes an oblique drawing of the antenna apparatus with dielectric inserted described in embodiment 15 of the present invention (FIG. 29A), and an oblique drawing the antenna apparatus with no dielectric inserted (FIG. 29B.
Figure 29B:
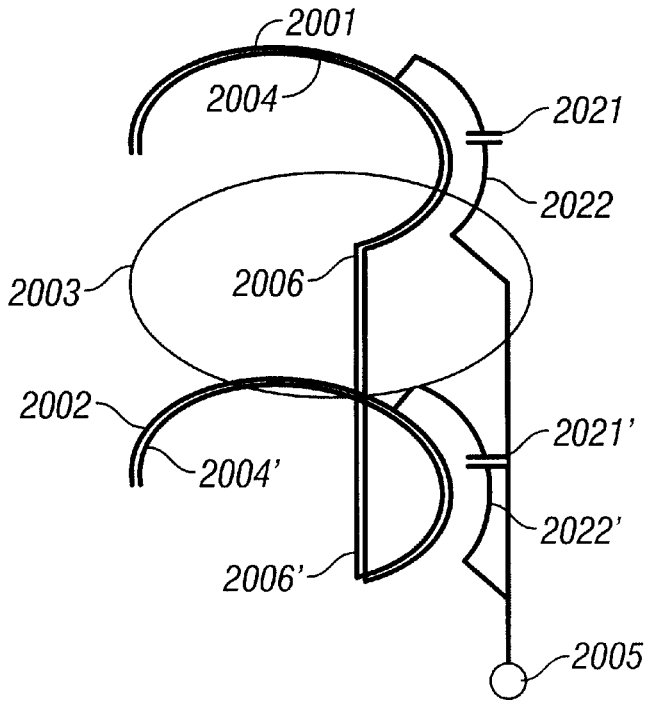

First, the configuration of the antenna apparatus in embodiment 15 will be described with reference to FIG. 29. In the antenna apparatus shown in FIG. 29A, a dielectric 2007 is inserted between (1) a first spiral radiating element 2001 and a spiral parasitic element 2004 installed parallel to the first spiral radiating element 2001, and (2) a second spiral radiating element 2002 and a spiral parasitic element 2004' installed parallel to the second spiral radiating element 2002, whereas such a dielectric is not inserted in the antenna apparatus shown in FIG. 29B; the antenna apparatus of the present embodiment below has a configuration in which a dielectric is inserted.

The antenna apparatus in embodiment 16 differs from the antenna apparatus in embodiment 14 in being equipped with capacitors 2021 and 2021', described next.

Capacitor 2021 is connected to the first feeder line 2022 on the first spiral radiating element 2001 side, and capacitor 2021' is connected to the second feeder line 2022' on the second spiral radiating element 2002 side. By connecting the capacitors, it is possible to cancel the reactance component generated by the feeder line and to measure only the actual impedance component, making it easy to achieve antenna impedance matching.

The operation of the antenna apparatus in embodiment 16 that has this kind of configuration is the same as the operation of the antenna apparatus in embodiment 14.

Embodiment 16

Figure 30A:
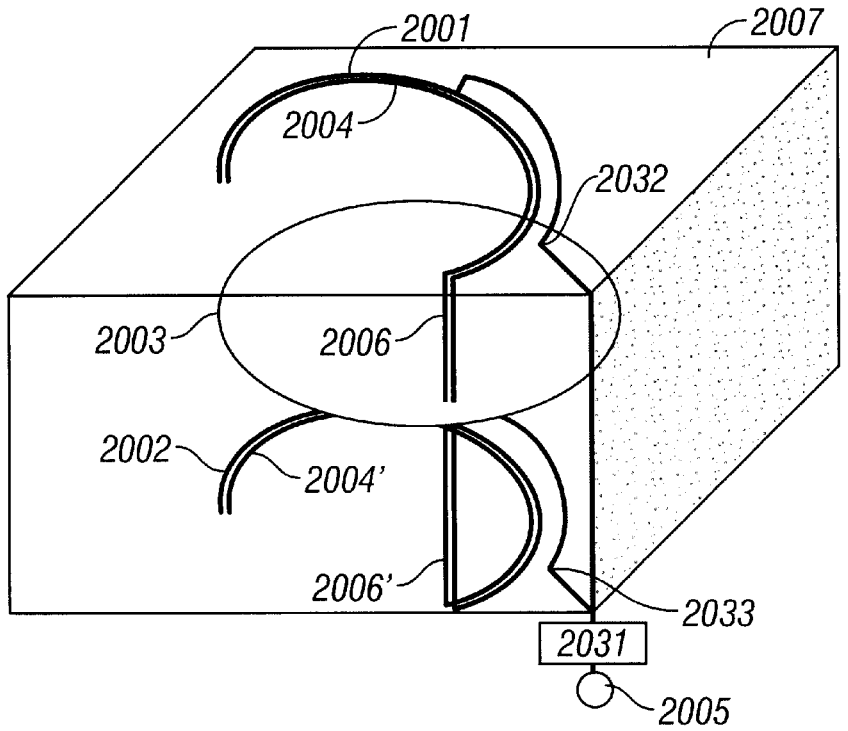
FIG. 30 includes an oblique drawing of the antenna apparatus with dielectric inserted described in embodiment 16 of the present invention (FIG. 30A), and an oblique drawing of the antenna apparatus with no dielectric inserted (FIG. 30B.
Figure 30B:
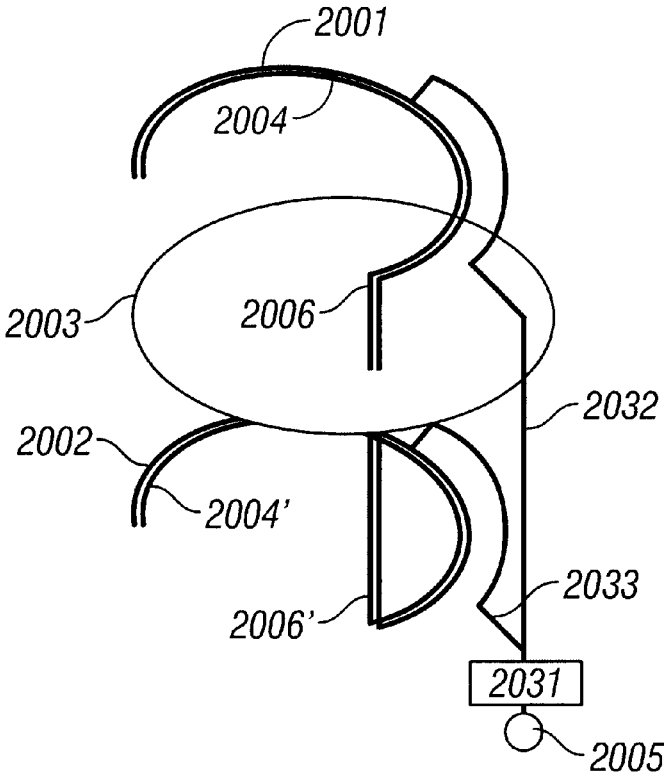

First, the configuration of the antenna apparatus in embodiment 16 will be described with reference to FIG. 30. In the antenna apparatus shown in FIG. 30A, a dielectric 2007 is inserted between (1) a first spiral radiating element 2001 and a spiral parasitic element 2004 installed parallel to the first spiral radiating element 2001, and (2) a second spiral radiating element 2002 and a spiral parasitic element 2004' installed parallel to the second spiral radiating element 2002, whereas such a dielectric is not inserted in the antenna apparatus shown in FIG. 30B; the antenna apparatus of the present embodiment below has a configuration in which a dielectric is inserted.

The antenna apparatus in embodiment 16 differs from the antenna apparatus in embodiment 14 in being equipped with a mixer 2031, described next.

The mixer 2031 is connected between a first feeder line 2032 on the first spiral radiating element 2001 side and a second feeder line 2033 on the second spiral radiating element 2002 side, and is means for performing feeding from the feed terminal 2005 via the mixer 2031. By means of the mixer 2031, the signal on the first spiral radiating element 2001 side and the signal on the second spiral radiating element 2002 side are separated, and the degree of separation of the first spiral radiating element 2001 and the second spiral radiating element 2002 is improved. By this means, it is possible to eliminate mutual influence between the first spiral radiating element 2001 and the second spiral radiating element 2002.

The operation of the antenna apparatus in embodiment 16 that has this kind of configuration is the same as the operation of the antenna apparatus in embodiment 14.

Embodiment 17

Figure 31:
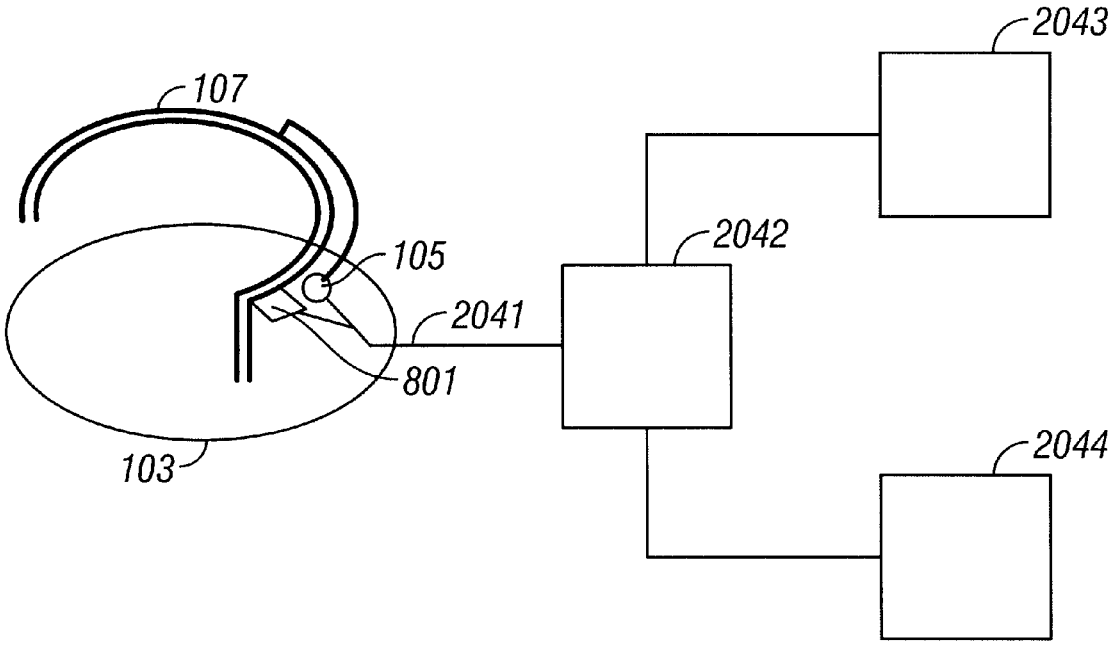
FIG. 31 is a configuration diagram of the communication system described in embodiment 17 of the present invention.

First, the configuration of the communication system in embodiment 17 will be described with reference to FIG. 31.

Here, a coaxial cable 2041 is connected to the antenna apparatus in embodiment 13. The coaxial cable 2041 connects the antenna apparatus to a communication apparatus for linear polarization 2043 and a communication apparatus for circular polarization 2044 via a distributor 2042; the antenna apparatus shown in FIG. 31 is the antenna apparatus in embodiment 13 (but with the dielectric not shown), and as described above, the cable ground of the coaxial cable is connected to the cable earth 801, and the coaxial cable signal line is connected to the feed terminal 105.

The antenna apparatus connected to the coaxial cable 2041 may be the antenna apparatus in any of the above described embodiments, and, as described above, is an antenna apparatus with hemispherical directivity in embodiments 1 to 13, or with spherical directivity in embodiments 14 to 16.

The possession of hemispherical or spherical directivity makes it possible to receive both electric waves from the ground and electric waves from an artificial satellite (the antenna apparatus in embodiment 13 that has hemispherical directivity is provided with transmission and reception capability for both the linear polarization used in ground communication and the circular polarization used in communication with an artificial satellite, and an antenna apparatus that has spherical directivity (such as the antenna apparatus in embodiment 14) is also provided with transmission and reception capability for both linear polarization and circular polarization).

By using the configuration shown in embodiment 17, both a communication apparatus that receives electric waves from the ground and a communication apparatus that receives electric waves from an artificial satellite can be used simultaneously with a single antenna apparatus, enabling the configuration of a communication system to be simplified.

The feed terminal in the present invention need not be provided on the first radiating element as in embodiments 1 to 13, but may instead be provided on the second radiating element.

Also, the inductance in the present invention is provided in the above described embodiments, but this is not a limitation, and it need not be provided. However, in a case where, for example, the inductance 109 is not provided, the limit of the length L1 of the linear radiating element 101, and the limit of the length L3 of the spiral radiating element 107, are both about ½ of the electric wave wavelength.

Also, the dielectric in the present invention need not be formed from ceramic material as in the above described embodiments, but may instead be formed from Dupont, Teflon, epoxy resin, ABS, etc. Further, the dielectric in the present invention is inserted, in the above described embodiments, only between the first radiating element and second radiating element of the present invention, but this is nota limitation, and, for example, it may instead (1) be inserted so that the first radiating element and second radiating element are contained therein, or (2) be inserted so that the first radiating element and third radiating element are contained therein, or (3) be inserted between the first radiating element and second radiating element and/or between the second radiating element and third radiating element, or (4) not be inserted. However, a lower antenna apparatus height is realized by inserting a dielectric with a high dielectric constant.

Also, the cover in the present invention need not be formed from ceramic material as in the above described embodiments, but may instead be formed from Dupont, Teflon, epoxy resin, ABS, etc.

Also, the first radiating element and third radiating element in the present invention are both spiral in shape in above described embodiments 14 to 16, but this is not a limitation, and instead, for example, (1) both may be linear in shape, or (2) the first radiating element may be linear in shape while the third radiating element is spiral in shape.

Also, the first radiating element and third radiating element in the present invention are each provided with a parallel spiral parasitic element in above described embodiments 14 to 16, but this is not a limitation, and instead, for example, (1) neither may be provided with a parallel spiral parasitic element, or (2) only the first radiating element may be provided with a parallel spiral parasitic element.

Also, in above described embodiments 14 to 16, a first feeder line is provided-for the first radiating element in the present invention, a second feeder line is provided for the second radiating element in the present invention, and common feeding is performed for the first feeder line and the second feeder line, but this is not a limitation, and instead, for example, it is possible (1) for the first feeder line and/or second feeder line not to be provided, and feeding to be performed directly, or (2) for feeding to be performed independently to the first feeder line and the second feeder line regardless of whether or not feeder lines are provided.

Also, the pedestal in the present invention is an electric conductor in above described embodiment 10, but this is not a limitation, and it need not be an electric conductor.

Also, the reactance element in the present invention is a capacitor in the above described embodiments, but this is not a limitation, and it may instead be a coil, etc.

As is clear from the above descriptions, a first present invention corresponding to claim 1 can provide an antenna apparatus characterized by realizing high gain and an increase in specific bandwidth.

A second present invention corresponding to claim 2 can provide an antenna apparatus characterized by having stable operation, in addition to the above described effects.

A third present invention corresponding to claim 3 can provide an antenna apparatus characterized by having a simple structure, in addition to the above described effects.

A fourth present invention corresponding to claim 4 can provide an antenna apparatus characterized by realizing high gain, in addition to the above described effects.

A fifth present invention corresponding to claim 5 can provide an antenna apparatus characterized by having a simple structure, in addition to the above described effects.

A sixth present invention corresponding to claim 6 can provide an antenna apparatus characterized by realizing high gain, in addition to the above described effects.

A seventh present invention corresponding to claim 7 can provide an antenna apparatus characterized by realizing a low apparatus height, in addition to the above described effects.

An eighth present invention corresponding to claim 8 can provide an antenna apparatus characterized by realizing a small apparatus size, in addition to the above described effects.

A ninth present invention corresponding to claim 9 can provide an antenna apparatus characterized by realizing compactness of the apparatus, in addition to the above described effects.

A tenth present invention corresponding to claim 10 can provide an antenna apparatus characterized by having a stable structure, in addition to the above described effects.

An eleventh present invention corresponding to claim 11 can provide an antenna apparatus characterized by not requiring a separate case, in addition to the above described effects.

A twelfth present invention corresponding to claim 12 can provide an antenna apparatus characterized by the fact that manufacture is simple, in addition to the above described effects.

A thirteenth present invention corresponding to claim 13 can provide an antenna apparatus characterized by little noise and by having good durability, in addition to the above described effects.

A fourteenth present invention corresponding to claim 14 can provide an antenna apparatus characterized by improving simplicity of setting the apparatus, in addition to the above described effects.

A fifteenth present invention corresponding to claim 15 can provide an antenna apparatus characterized by having stable operation, in addition to the above described effects.

A sixteenth present invention corresponding to claim 16 can provide an antenna apparatus characterized by greater simplicity of performance adjustment in manufacture, in addition to the above described effects.

A seventeenth present invention corresponding to claim 17 can provide an antenna apparatus characterized by realizing high gain, in addition to the above described effects.

An eighteenth present invention corresponding to claim 18 can provide an antenna apparatus characterized by having high gain in all directions three-dimensionally, in addition to the above described effects.

A nineteenth present invention corresponding to claim 19 can provide an antenna apparatus characterized by a small difference in gain according to direction, and stable high gain in all directions, in addition to the above described effects.

A twentieth present invention corresponding to claim 20 can provide an antenna apparatus characterized by realizing high gain, in addition to the above described effects.

A twenty-first present invention corresponding to claim 21 can provide an antenna apparatus characterized by realizing a low apparatus height, in addition to the above described effects.

A twenty-second present invention corresponding to claim 22 can provide an antenna apparatus characterized by having a simple structure, in addition to the above described effects.

A twenty-third present invention corresponding to claim 23 can provide an antenna apparatus characterized by greater simplicity of performance adjustment in manufacture, in addition to the above described effects.

A twenty-fourth present invention corresponding to claim 24 can provide an antenna apparatus characterized by having stable operation, in addition to the above described effects.

A twenty-fifth present invention corresponding to claim 25 can provide a communication system characterized by having a simple structure.

A twenty-sixth present invention corresponding to claim 26 can provide a communication system characterized by having a simple structure.

What is claimed is:

1. An antenna apparatus, comprising:

a first radiating element located on a first side of said antenna apparatus, said first radiation element having an earth position determining tab being an end of a feed terminal;

a second radiating element located opposite said first radiating element; and an earth located at a second side of said antenna apparatus that is opposite to said first side of said apparatus, said second radiating element intervening between said first radiating element and earth;

wherein said first radiating element or said second radiating element is equipped with said feed terminal, and electric fields are generated at least between said first radiating element and said second radiating element, and between said second radiating element and said earth, and electric wave transmission and reception is performed.

2. The antenna apparatus according to claim 1, wherein said first radiating element is connected to said second radiating element via a prescribed inductance.

3. The antenna apparatus according to either claim 1 or claim 2, wherein said first radiating element is rectilinear in shape.

4. The antenna apparatus according to either claim 1 or claim 2, wherein a linear parasitic element is provided parallel to said first radiating element.

5. The antenna apparatus according to either claim 1 or claim 2, wherein said first radiating element is spiral in shape.

6. The antenna apparatus according to claim 5, wherein a spiral parasitic element is provided in parallel to said first radiating element.

7. The antenna apparatus according to either claim 1 or claim 2, wherein a dielectric is inserted between said first radiating element and said second radiating element.

8. The antenna apparatus according to either claim 1 or claim 2, wherein said earth is an earth plate with a finite area larger than the area of said second radiating element.

9. The antenna apparatus according to either claim 1 or claim 2, wherein a printed circuit board is installed between said first radiating element and said second radiating element, and said first radiating element is formed upon that printed circuit board.

10. The antenna apparatus according to either claim 1 or claim 2, wherein said first radiating element or said second radiating element is supported by a support.

11. The antenna apparatus according to either claim 1 or claim 2, wherein said earth forms a case housing said first radiating element and said second radiating element.

12. The antenna apparatus according to either claim 1 or claim 2, wherein said first radiating element, said second radiating element, and said earth are covered by a cover, and said first radiating element and said cover are separated by a predetermined distance.

13. The antenna apparatus according to either claim 1 or claim 2, comprising a pedestal unit, between said second radiating element and said earth, that is in contact with said earth but is not in contact with said second radiating element.

14. The antenna apparatus according to claim 1, comprising a feeder line for connecting said feed terminal to said first radiating element, wherein said feed terminal is provided in the vicinity of said earth position determining tab.

15. The antenna apparatus according to claim 14, wherein a reactance element is fitted to said feeder line.

16. The antenna apparatus according to claim 14, wherein said earth position determining tab is located on the same level as said first radiating element.

17. The antenna apparatus according to claim 1, wherein earth is indirectly connected to said first and second radiating elements.

18. An antenna apparatus, comprising:

a first radiating element located on a first side of said antenna apparatus, said first radiating element having an earth position determining tab being an end of a feed terminal;

a second radiating element located opposite said first radiating element; and a third radiating element on a second side of said antenna apparatus that is opposite to said first side of said apparatus, said second radiating element intervening between said first radiating element and said third radiating element, wherein said first radiating element and said third radiating element are equipped with a feed terminal common to both, and electric fields are generated at least between said first radiating element and said second radiating element, and between said second radiating element and said third radiating element, and electric wave transmission and reception is performed.

19. The antenna apparatus according to claim 18, wherein said first radiating element and said third radiating element are both rectilinear in shape, or both spiral in shape.

20. The antenna apparatus according to claim 19, wherein said first radiating element and said third radiating element are both spiral in shape, and a spiral parasitic element is provided parallel to each.

21. The antenna apparatus according to claims 18, wherein a dielectric is inserted between said first radiating element and said second radiating element, and/or between said second radiating element and said third radiating element.

22. The antenna apparatus according to claim 18, comprising:

a first feeder line for performing feeding to said first radiating element; and a second feeder line for performing feeding to said second radiating element, wherein common feeding is performed for said first feeder line and said second feeder line.

23. The antenna apparatus according to claim 22, wherein a reactance element is fitted to said first feeder line or said second feeder line.

24. The antenna apparatus according to claim 22, comprising a mixer, for performing common feeding used for said electric wave transmission and reception, for said first feeder line and said second feeder line.

25. A communication system, comprising:

an antenna apparatus including:

a first radiating element located on a first side of said antenna apparatus said first radiating element having an earth position determining tab being an end of a feed terminal;

a second radiating element located opposite said first radiating element; and an earth located at a second side of said antenna apparatus that is opposite to said first side of said apparatus, said second radiating element intervening between said first radiating element and earth, wherein said first radiating element or said second radiating element is equipped with a feed terminal, electric fields are generated at least between said first radiating element and said second radiating element, and between said second radiating element and said earth, and electric wave transmission and reception is performed; and a distributor for connecting said feed terminal to a communication apparatus for linear polarization and/or a communication apparatus for circular polarization.

26. The communication system according to claim 25, wherein earth is indirectly connected to said first and second radiating elements.

27. A communication system, comprising:

an antenna apparatus including:

a first radiating element, said first radiating element having an earth position determining tab being an end of a feed terminal;

a second radiating element located opposite said first radiating element; and a third radiating element that is located at a second side of said antenna apparatus that is opposite to said first side of said apparatus, said second radiating element intervening between said first radiating element and earth, wherein said first radiating element and said third radiating element are equipped with a feed terminal, electric fields are generated at least between said first radiating element and said second radiating element, and between said second radiating element and said third radiating element, and electric wave transmission and reception is performed; and a distributor for connecting said feed terminal to a communication apparatus for linear polarization and/or a communication apparatus for circular polarization.

* * * * *

UNITED STATES PATENT AND TRADEMARK OFFICE

CERTIFICATE OF CORRECTION

PATENT NO. : 6,608,594 B1
APPLICATION NO. : 09/680263
DATED : August 19, 2003
INVENTOR(S) : Joji Kane et al.

It is certified that error appears in the above-identified patent and that said Letters Patent is hereby corrected as shown below:

In claim 22, column 20, line 64, replace "feeding to said second" with --feeding to said third--.

Signed and Sealed this

Ninth Day of January, 2007

JON W. DUDAS
*Director of the United States Patent and Trademark Office*